US010899593B2

(12) United States Patent
Koretz et al.

(10) Patent No.: US 10,899,593 B2
(45) Date of Patent: Jan. 26, 2021

(54) LIQUID DISPENSING DEVICE

(71) Applicant: Wine Plum, Inc., Dania Beach, FL (US)

(72) Inventors: David Andrew Koretz, Miami, FL (US); Donald G. Hubbard, Jr., Hollywood, FL (US); Niculae Mustatea, Sunrise, FL (US); Michael Dumont, San Francisco, CA (US); Kyle Adams, Brisbane, CA (US); Raul Eugene Chinda, Ft. Lauderdale, FL (US); David Henry Caldwell Karl, Ft. Lauderdale, FL (US); Travis Ronald Coleman, Sunrise, FL (US); Benjamin Jonas Hafen, Sunrise, FL (US)

(73) Assignee: Wine Plum, Inc., Dania Beach, FL (US)

( * ) Notice: Subject to any disclaimer, the term of this patent is extended or adjusted under 35 U.S.C. 154(b) by 428 days.

(21) Appl. No.: 15/625,453

(22) Filed: Jun. 16, 2017

(65) Prior Publication Data

US 2017/0334704 A1 Nov. 23, 2017

Related U.S. Application Data

(63) Continuation-in-part of application No. 15/288,774, filed on Oct. 7, 2016, which is a continuation-in-part
(Continued)

(51) Int. Cl.
*B67D 1/08* (2006.01)
*B67D 1/04* (2006.01)
(Continued)

(52) U.S. Cl.
CPC ..... *B67D 1/0829* (2013.01); *B01F 3/04248* (2013.01); *B01F 3/04794* (2013.01);
(Continued)

(58) Field of Classification Search
CPC ..... B01F 3/04794; B01F 15/0212; B01F 3/04248; B01F 2215/0072;
(Continued)

(56) References Cited

U.S. PATENT DOCUMENTS 276,804 A * 5/1883 Green ..... B67B 7/0441 81/3.29
695,235 A * 3/1902 Riolet ..... B67B 7/0441 81/3.37
(Continued)

FOREIGN PATENT DOCUMENTS

CN 2892716 Y 4/2007
CN 101670997 A 3/2010
(Continued)

OTHER PUBLICATIONS

First Office Action issued in corresponding Chinese Application No. 201580069619.0, dated Nov. 14, 2018.
(Continued)

*Primary Examiner* — Stephen Hobson
(74) *Attorney, Agent, or Firm* — Chamberlain, Hrdlicka, White, Williams & Aughtry

(57) ABSTRACT

A liquid dispensing device includes a needle. The needle is adapted to penetrate a container without tearing out a portion of the container. The portion of the container is near a point of penetration on the container. The liquid dispensing device includes a motion control system. The motion control system is configured to rotate the needle while the needle penetrates the container.

20 Claims, 28 Drawing Sheets

Related U.S. Application Data of application No. 14/825,888, filed on Aug. 13, 2015, now Pat. No. 10,258,937, and a continuation-in-part of application No. 14/826,111, filed on Aug. 13, 2015, now Pat. No. 9,708,575.

(60) Provisional application No. 62/093,356, filed on Dec. 17, 2014.

(51) Int. Cl.

| | |
|---|---|
| ***B01F 3/04*** | (2006.01) |
| ***B67D 1/12*** | (2006.01) |
| ***B01F 15/02*** | (2006.01) |
| ***B67D 1/00*** | (2006.01) |

(52) U.S. Cl.

CPC ..... *B01F 15/0212* (2013.01); *B67D 1/0004* (2013.01); *B67D 1/04* (2013.01); *B67D 1/0406* (2013.01); *B67D 1/0437* (2013.01); *B67D 1/0809* (2013.01); *B67D 1/0869* (2013.01); *B67D 1/0884* (2013.01); *B67D 1/0888* (2013.01); *B67D 1/0891* (2013.01); *B67D 1/1252* (2013.01); *B01F 2003/0434* (2013.01); *B01F 2003/04319* (2013.01); *B01F 2215/0072* (2013.01); *B67D 1/0858* (2013.01); *B67D 1/0895* (2013.01); *B67D 2001/0092* (2013.01); *B67D 2001/0093* (2013.01); *B67D 2001/0098* (2013.01); *B67D 2001/0481* (2013.01); *B67D 2001/082* (2013.01); *B67D 2001/0814* (2013.01); *B67D 2210/00031* (2013.01)

(58) Field of Classification Search

CPC ... B01F 2003/04319; B01F 2003/0434; B67D 1/0829; B67D 1/1252; B67D 1/0437; B67D 1/0884; B67D 1/0004; B67D 1/0809; B67D 1/0891; B67D 1/04; B67D 1/0869; B67D 1/0406; B67D 1/0888; B67D 2001/0098; B67D 2001/0481; B67D 1/0895; B67D 1/0858; B67D 2001/082; B67D 2210/00031; B67D 2001/0092; B67D 2001/0093; B67D 2001/0814

See application file for complete search history.

(56) References Cited

U.S. PATENT DOCUMENTS 718,163 A * 1/1903 Sherrard ..... B67D 1/0425 222/82
1,041,699 A * 10/1912 Thompson, Jr. ..... 222/91
1,938,484 A * 12/1933 Clarin ..... B67B 7/0405 81/3.2
2,612,065 A * 9/1952 Packer ..... B67B 7/164 81/3.2
3,174,650 A * 3/1965 Bellato ..... E04C 5/18 81/3.33
3,227,310 A * 1/1966 Farandatos ..... B67D 1/04 222/5
3,883,043 A * 5/1975 Lane ..... B67D 1/0412 222/82
4,011,971 A * 3/1977 Haydon ..... B67D 1/1252 222/399
4,308,975 A 1/1982 Bowen
4,691,842 A 9/1987 Foures
4,766,780 A * 8/1988 Sechen ..... B67B 7/0405 81/3.2
4,930,689 A 6/1990 Stumpf
4,984,711 A * 1/1991 Ellis ..... B67B 7/26 222/152
5,005,446 A * 4/1991 Mackey ..... B67B 7/08 141/19
5,020,395 A 6/1991 Mackey
5,086,675 A 2/1992 Leung
5,095,778 A * 3/1992 Bocsi ..... B67B 7/0405 81/3.2
5,372,054 A * 12/1994 Federighi, Sr. ..... B67B 7/0405 30/1.5
5,404,922 A 4/1995 Sliter
5,490,321 A * 2/1996 Kaneko ..... B23P 19/04 29/235
5,517,867 A 5/1996 Ely et al.
5,724,869 A * 3/1998 May ..... B67B 7/0405 81/3.08
5,802,863 A 9/1998 Cowans
6,216,913 B1 4/2001 Bilskie et al.
6,321,620 B1 * 11/2001 Fabbro ..... B67B 7/0405 81/3.09
6,557,459 B1 5/2003 Phelps et al.
6,658,859 B2 12/2003 Phelps et al.
6,752,041 B2 6/2004 Lee
6,913,167 B2 7/2005 Phelps et al.
7,234,375 B1 * 6/2007 Wang Wu ..... B67B 7/08 81/3.2
7,254,952 B2 8/2007 Lilke
7,596,956 B2 10/2009 Lilke
7,712,637 B2 * 5/2010 Lambrecht ..... B67D 1/0418 222/400.7
7,815,865 B2 10/2010 Hoffman et al.
7,918,400 B2 4/2011 Baltuch
8,011,276 B2 * 9/2011 Varme ..... B67B 7/04 81/3.45
8,033,431 B2 10/2011 Sommerfield et al.
8,109,301 B1 2/2012 Denise
8,141,746 B2 3/2012 Lambrecht
8,225,959 B2 7/2012 Lambrecht
8,248,254 B2 8/2012 Vogt et al.
8,272,538 B2 9/2012 Weinberg et al.
8,326,354 B2 12/2012 Ahn
8,371,478 B2 2/2013 Sommerfield et al.
8,453,888 B2 6/2013 Sommerfield et al.
8,490,832 B2 7/2013 Lambrecht
8,556,136 B2 10/2013 Kluynh
8,578,819 B2 * 11/2013 Cheung ..... B67B 7/0405 81/3.2
8,640,919 B2 2/2014 Lambrecht
8,746,502 B2 6/2014 Lambrecht
8,880,427 B1 11/2014 Jones
8,910,829 B2 12/2014 Lazaris et al.
9,010,588 B2 4/2015 Lambrecht
9,016,502 B2 4/2015 Hollars et al.
9,016,517 B2 4/2015 Craft
9,181,021 B2 11/2015 Manera
9,637,367 B1 * 5/2017 Arnold ..... B65D 39/16
2001/0013500 A1 * 8/2001 Gilley ..... B65D 39/16 215/299
2003/0213814 A1 * 11/2003 Phelps ..... B67D 1/04 222/146.6
2004/0118291 A1 * 6/2004 Carhuff ..... A47J 31/4485 99/275
2004/0244541 A1 * 12/2004 Lin ..... B67B 7/08 81/3.2
2007/0023430 A1 2/2007 Seher et al.
2007/0233567 A1 10/2007 Daly
2008/0054015 A1 3/2008 Moezidis
2008/0098854 A1 * 5/2008 Goldstein ..... B67B 7/0447 81/3.29
2010/0005811 A1 1/2010 Jaffe et al.
2010/0006603 A1 * 1/2010 Weinberg ..... B67D 1/0885 222/152
2010/0147417 A1 6/2010 Dorney
2010/0155419 A1 * 6/2010 Nishino ..... B67D 3/0051 222/81
2011/0017776 A1 1/2011 Metropulos et al.
2011/0204093 A1 * 8/2011 Lee ..... B67D 1/0418 222/152
2011/0253746 A1 10/2011 O'Keefe, Jr.
2011/0298583 A1 12/2011 Libby et al.

(56) References Cited

U.S. PATENT DOCUMENTS

| | | | | |
|---|---|---|---|---|
| 2012/0080445 | A1* | 4/2012 | Moezidis | F25D 31/007 222/1 |
| 2012/0245732 | A1 | 9/2012 | Yoakim | |
| 2013/0085600 | A1 | 4/2013 | Nicol et al. | |
| 2013/0129876 | A1 | 5/2013 | Ye et al. | |
| 2013/0306673 | A1* | 11/2013 | Manera | B65D 83/32 222/82 |
| 2014/0091107 | A1 | 4/2014 | Becker et al. | |
| 2014/0097198 | A1* | 4/2014 | Lazaris | B67D 1/0809 222/5 |
| 2014/0103065 | A1* | 4/2014 | Lambrecht | B67D 1/0042 222/81 |
| 2014/0110431 | A1 | 4/2014 | Lambrecht | |
| 2014/0124530 | A1 | 5/2014 | Craft | |
| 2014/0224833 | A1 | 8/2014 | Lambrecht | |
| 2014/0252046 | A1 | 9/2014 | Rider et al. | |
| 2014/0339189 | A1 | 11/2014 | Moore et al. | |
| 2015/0265093 | A1* | 9/2015 | Guo | B01F 3/04453 261/64.1 |
| 2015/0344180 | A1 | 12/2015 | Shakoori Divani | |
| 2016/0052763 | A1* | 2/2016 | Lemper | B67B 7/08 81/3.2 |
| 2016/0175781 | A1* | 6/2016 | Hubbard, Jr. | B67D 1/04 261/77 |
| 2016/0339398 | A1* | 11/2016 | Stevenson | B01F 3/04794 |
| 2017/0014783 | A1* | 1/2017 | Viale | B01F 3/04794 |
| 2017/0129758 | A1* | 5/2017 | Hume | B67B 7/08 |
| 2018/0222740 | A1 | 8/2018 | Tomesch et al. | |
| 2019/0031481 | A1* | 1/2019 | Soussan | B67B 7/08 |
| 2019/0151808 | A1* | 5/2019 | Giardullo | B01F 3/04744 |

FOREIGN PATENT DOCUMENTS

| | | | |
|---|---|---|---|
| CN | 101754923 | A | 6/2010 |
| CN | 102009934 | A | 4/2011 |
| CN | 102871548 | A | 1/2013 |
| CN | 203319683 | U | 12/2013 |
| CN | 203578303 | U | 5/2014 |
| CN | 103889883 | A | 6/2014 |
| EP | 2165967 | A1 | 3/2010 |
| FR | 8910853 | | 8/1989 |
| JP | 2006-327683 | A | 12/2006 |
| WO | 2005/058744 | A2 | 6/2005 |
| WO | 2007017234 | A1 | 2/2007 |
| WO | 2009000147 | A1 | 12/2008 |
| WO | 2011/067232 | A1 | 9/2011 |
| WO | 2012/129686 | A1 | 10/2012 |
| WO | 2016/099625 | A1 | 6/2016 |
| WO | 2016/099626 | A1 | 6/2016 |

OTHER PUBLICATIONS

International Search Report and Written Opinion issued in corresponding Application No. PCT/US2018/036716, dated Oct. 16, 2018.

"Gasket Handbook: A Technical Guide to Gasketing & Bolted Joints"; Lamons Gasket Company; Feb. 2012 (172 pages).

"Juicebox (container)" Wikipedia published Nov. 15, 2012 accessed at <https://en.wikipedia.org/w/index.php?title=Juicebox_(container)&oldid=523167246. 2 pages.

First Office Action issued in corresponding Chinese Application No. 201680068708.8, dated Jun. 1, 2020.

First Office Action issued in corresponding Chinese Application No. 201910618615.3, dated Jun. 28, 2020.

International Search Report issued in corresponding Application No. PCT/US2019/050752, dated Jan. 28, 2020.

Written Opinion issued in corresponding Application No. PCT/US2019/050752, dated Jan. 28, 2020.

* cited by examiner

LIQUID DISPENSING DEVICE

BACKGROUND

Liquids are transported and/or stored in containers. Each container may include a single or multiple servings of a liquid. Each container may maintain a quality of the liquid disposed in each container during transport and/or storage. The container may maintain the quality of the liquid by preventing oxidation or other chemical reactions from occurring while the liquid is transported and/or stored.

SUMMARY

In one aspect, a liquid dispensing device in accordance with one or more embodiments of the invention includes a needle adapted to penetrate a container without tearing out a portion of the container near a point of penetration on the container; and a motion control system configured to rotate the needle while the needle penetrates the container.

BRIEF DESCRIPTION OF DRAWINGS

Certain embodiments of the invention will be described with reference to the accompanying drawings. However, the accompanying drawings illustrate only certain aspects or implementations of the invention by way of example and are not meant to limit the scope of the claims.

DETAILED DESCRIPTION

Figure 1:
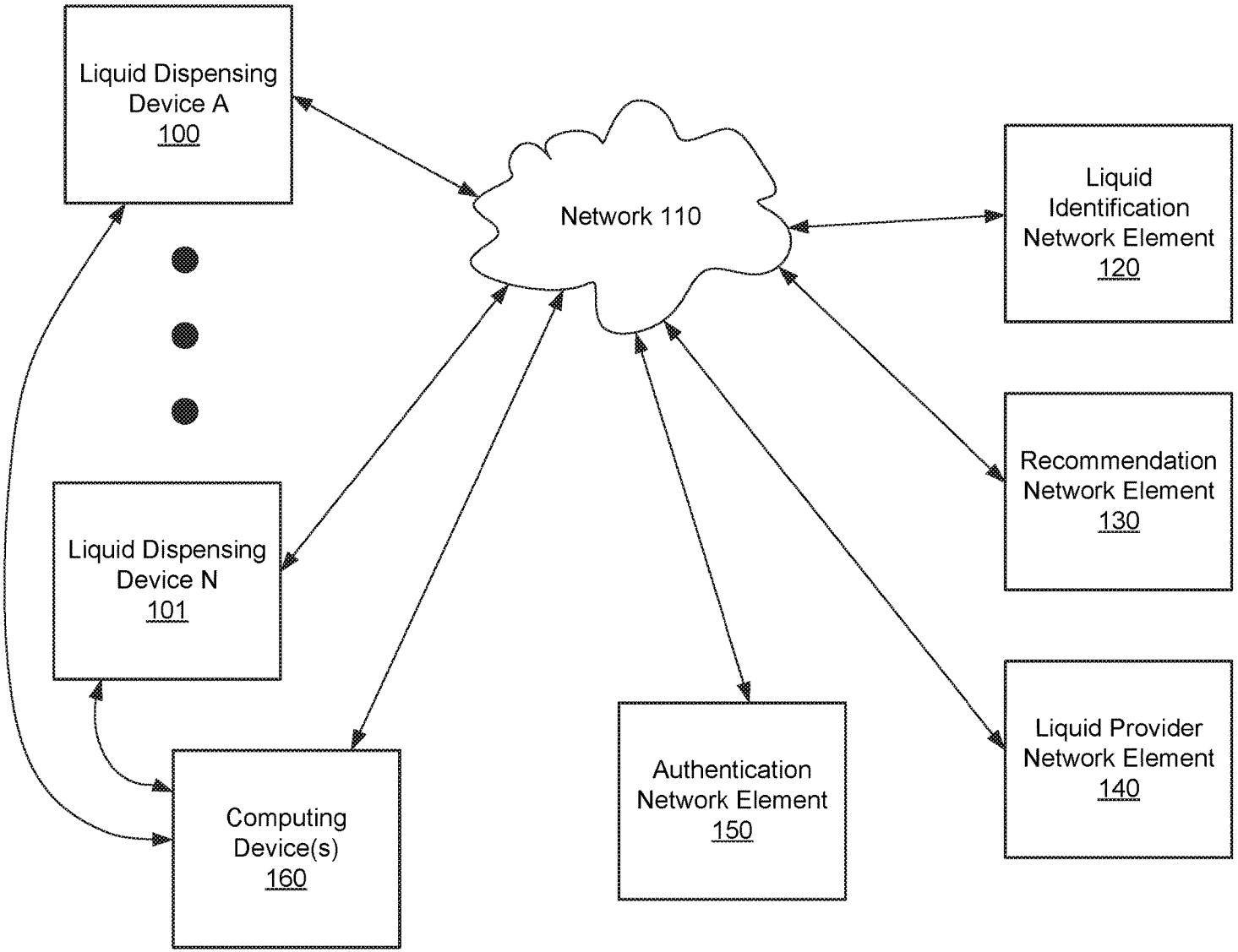
FIG. 1 shows a system in accordance with one or more embodiments of the invention.

Specific embodiments will now be described with reference to the accompanying figures. In the following description, numerous details are set forth as examples of the invention. It will be understood by those skilled in the art that one or more embodiments of the present invention may be practiced without these specific details and that numerous variations or modifications may be possible without departing from the scope of the invention. Certain details known to those of ordinary skill in the art are omitted to avoid obscuring the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-11, any component described with regard to a figure, in various embodiments of the technology, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments of the technology, any description of the components of a figure is to be interpreted as an optional embodiment which may be implemented in addition to, in conjunction with, or in place of the embodiments described with regard to a corresponding like-named component in any other figure.

In general, embodiments of the invention relate to methods, systems, and devices for dispensing of liquids from containers. A liquid included in a container may be degraded when exposed to an ambient environment. The liquid may be exposed to the ambient environment when, for example, the container is opened to dispense the liquid or through heat transfer between the ambient environment surrounding the container and the liquid included in the container.

A liquid dispensing device in accordance with embodiments of the invention prevents or reduces the degradation rate of liquids in containers by shielding the liquids from the ambient environment. The liquid dispensing device may control atmospheric conditions within the container and thermal conditions of the liquid within the container.

The liquid dispensing device may also maintain an orientation of a container and thereby prevent solids or other materials included in the container from being dispensed along with a liquid included in the container. The orientation may be, for example, angling of a liquid extraction point on the container down.

The liquid dispensing device may also include a body that hides containers from the view of a user when the container is loaded in the liquid dispensing device. The liquid dispensing device may include a user interface that provides information to the user regarding the type of liquid, quantity of liquid, or other information to the user.

The liquid dispensing device may include an automated mechanism for preparing a container for extraction of liquid disposed in the container. The liquid dispensing device may include a platform on which a user places a liquid container. Once placed, the liquid dispensing device automatically prepares the container for extraction by penetrating the container.

The liquid dispensing device may further include an identification sensor for identifying a type of liquid disposed within a container. The identification sensor may be, for example, a camera that obtains an image of the container. The image may be compared to a library of images associated with containers and liquids contained therein. The image may be matched to one of the containers and the liquid contained in the container may be determined based on the match.

Additional embodiments of the invention may relate to systems for dispensing liquid. A system may include one or more liquid dispensing devices operably connected to one or more network elements via a network. The network elements may be, for example, authentication servers, liquid provider servers, and recommendation servers.

The authentication servers may enable a user to log into a liquid dispensing device. By logging onto the device, the user may be provided access to one or more functions of the liquid dispensing device that the user would otherwise be denied access.

The liquid provider servers may enable a liquid dispensing device to automatically notify a provider of liquids that a container is depleted. The liquid provider servers may then add new containers of liquid to the liquid dispensing device in response to the notification.

The recommendation servers may receive consumption data from the liquid dispensing devices. The consumption data may be associated with the user. The consumption data may be used to make a recommendation to the user of another container of liquid for consumption.

FIG. 1 shows a diagram of a system for dispensing liquids in accordance with one or more embodiments of the invention. The system includes a number of liquid dispensing device (100, 101) operably connected to a number of network elements (120, 130, 140, 150) and one more computing devices (160) via a network (110). The computing devices (160) may also be connected to the liquid dispensing devices (100, 101) via one or more separate connections such as a wireless local area network, blue tooth, near field communication, or other communication method.

The liquid dispensing devices (100, 101) may be physical devices for the dispensing of liquids included in containers. The liquids may be, for example, wine, champagne, beer, or any other liquid. The containers may be, for example, bottles sealed by a cork, screw top, or other mechanism. Refer to FIGS. 2-6F for additional details regarding the liquid dispensing device (100, 101).

The network elements (120, 130, 140, 150) may be physical devices. The network elements (120, 130, 140, 150) may be, for example, a server. Each of the network elements (120, 130, 140, 150) may be operably connected to the liquid dispensing devices (100, 101) via the network (110) and configured to support the operations of the dispensing devices (100, 101).

While each of the network elements (120, 130, 140, 150) are illustrated as being separate devices in FIG. 1, each of the network elements (120, 130, 140, 150) may be combined with other network elements without departing from the invention. For example, the liquid identification network element (120) and the recommendation network element (130) may be a single device without departing from the invention. Additionally, the functionality of one or more of the network elements (120, 130, 140, 150) may be provided by a computing cloud, rather than a specific device, without departing from the invention.

Figure 10:
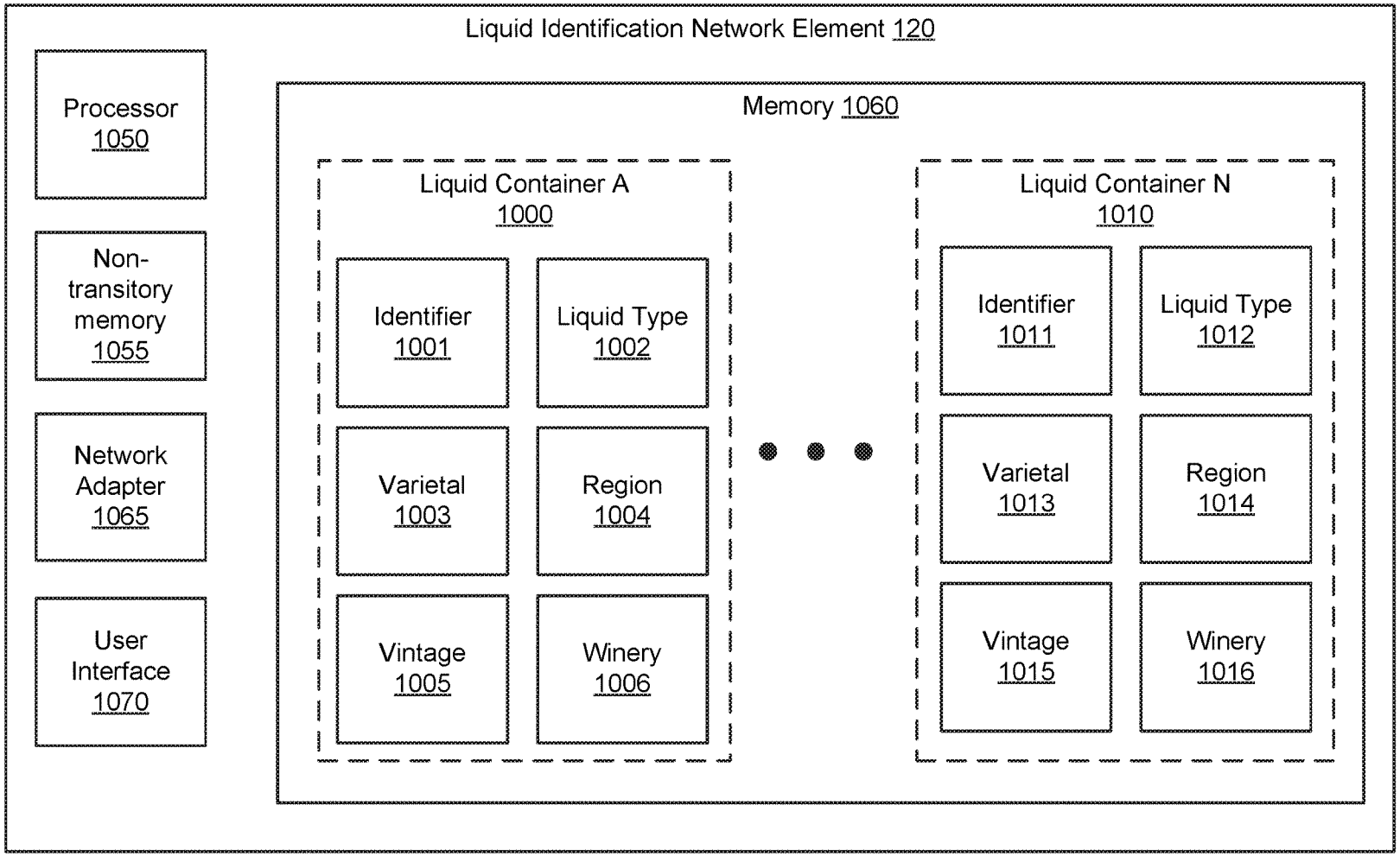
FIG. 10 shows a block diagram of a liquid identification network element in accordance with one or more embodiments of the invention.

The liquid identification network element (120) may include information that may be used to ascertain a type of liquid included in a container. Refer to FIG. 10 for additional details regarding the liquid identification network element (120).

Figure 11:
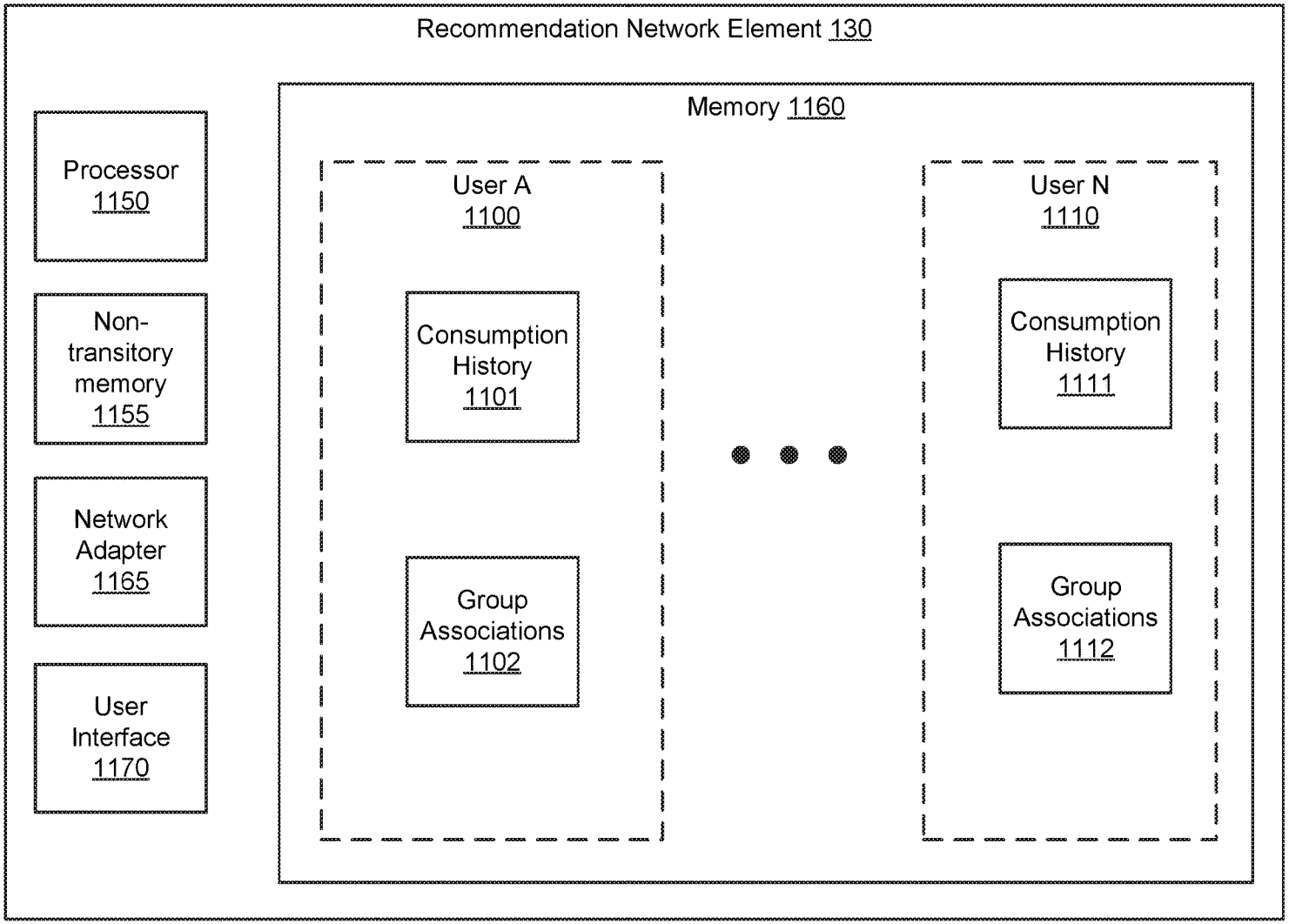
FIG. 11 shows a block diagram of a recommendation network element in accordance with one or more embodiments of the invention.

The recommendation network element (130) may include information that may be used to recommend a container of liquid for consumption by a user. Refer to FIG. 11 for additional details regarding the recommendation network element (130).

The liquid provider network element (140) may be a provider device that receives requests from liquid dispensing devices (100, 101) for containers of liquids. The provider may schedule deliveries of containers of liquids based on the requests.

The authentication network element (150) may be an authentication device for authenticating user of the liquid dispensing devices (100, 101). The authentication network element (150) may include log on information for users. Before a liquid dispensing device (100, 101) dispenses liquids from a container, the liquid dispensing device (100, 101) may require that a user be authenticated. By authenticating the user, the user may be uniquely identified and any liquids that are dispensed while the user is authenticated may be associated with the user.

The computing devices (160) may be physical devices such as, for example, cell phones, laptop computers, tablet computers, or other personal computing and/or communication devices. The computing devices (160) may be operably connected to the liquid dispensing devices (100, 101). An application may be executing on the computing devices (160) that enables a user of the computing devices (160) to issue commands to the liquid dispensing devices (160), obtain data from the liquid dispensing devices (160), authenticate a user of the liquid dispensing devices (160), or otherwise direct the functions of the liquid dispensing devices (160). In some embodiments of the invention, the computing devices (100, 101) may act as a bridge to the network (110).

The network (110) may be a telecommunications network that enables the exchange of information between devices connected to the network. The network (110) may be, for example, the Internet.

Figure 2:
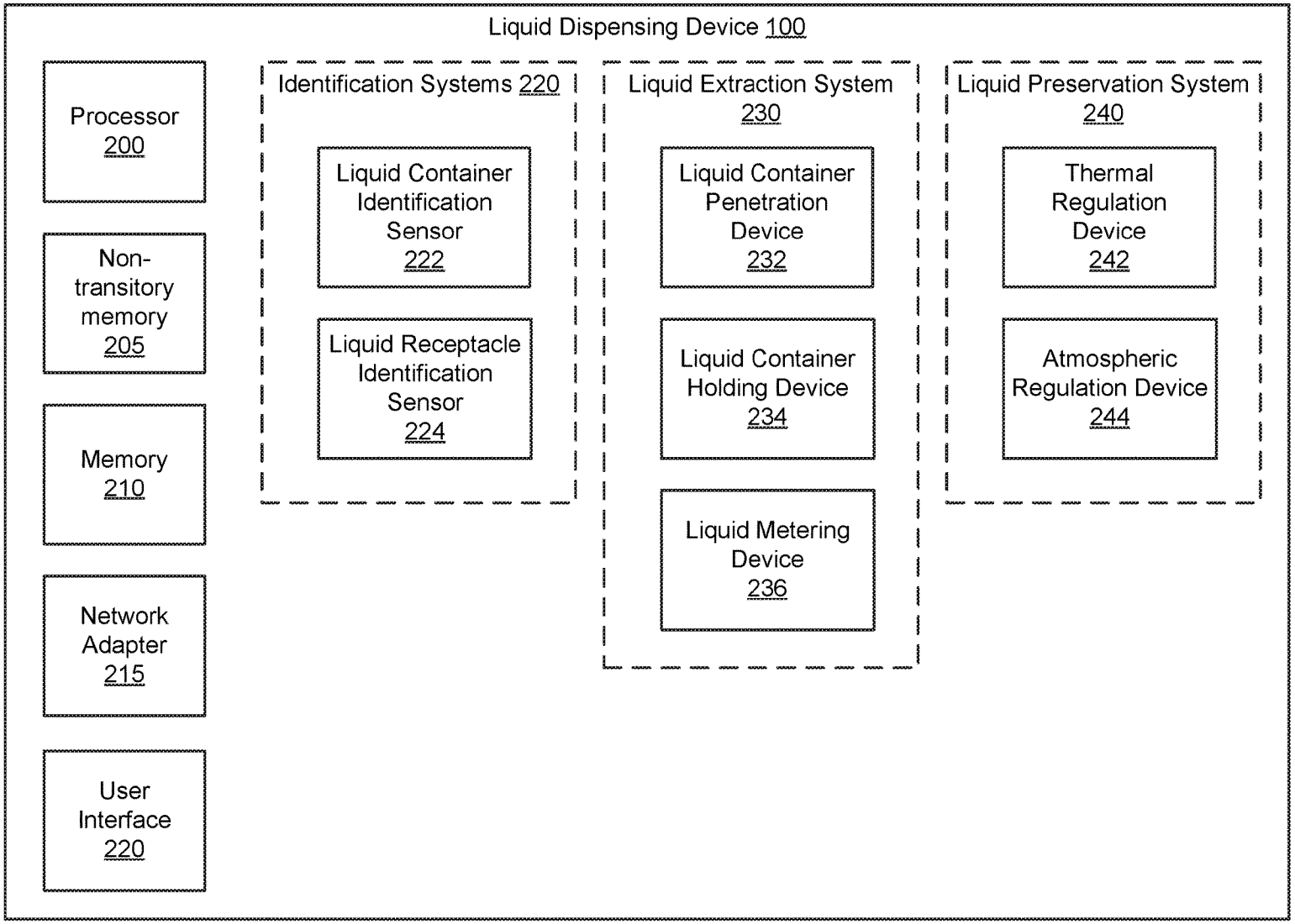
FIG. 2 shows a block diagram of a liquid dispensing device in accordance with one or more embodiments of the invention.

FIG. 2 shows a block diagram of a liquid dispensing device (100) in accordance with embodiments of the invention. The liquid dispensing device (100) may dispense liquids from a container while preserving the remaining liquids in the container for future dispensing. Additionally, the liquid dispensing device (100) may obtain dispensing information on a per-user and/or a per dispensing basis. The dispensing information may be sent to one or more network elements.

The liquid dispensing device (100) may include a processor (200). The processor (200) may be a physical device, including circuitry. The processor (200) may be, for example, a central processing unit, an embedded processor, a digital signal processor, a programmable gate array, or any other type of programmable computing device.

The processor (200) may be operably connected to a non-transitory computer readable memory (205) storing instructions. The non-transitory computer readable memory (205) may be a physical device such as a hard disk drive, a read only memory, or a solid state drive. The instructions, when executed by the processor (200), may cause the liquid dispensing device (100) to perform the functionality shown in FIGS. 7-9B.

The liquid dispensing device (100) may include memory (210) operably connected to the processor. The memory (210) may be a physical device such as random access memory. The memory (210) may be used for the temporary storage of data.

The liquid dispensing device (100) may include a network adapter (215). The network adapter (215) may be a physical device for accessing a network (110, FIG. 1). The network adapter may be, for example, an Ethernet adapter, a fiber optic network adapter, or a wireless network adapter. The network adapter (215) may enable the liquid dispensing device (100) to exchange information with network elements (e.g., 120, 130, 140, 150, etc.).

The liquid dispensing device (100) may include a user interface (220). The user interface (220) may be a physical component for interacting with the liquid dispensing device (100). The liquid dispensing device (200) may include, for example, a display, a touch sensitive display, buttons, and/or switches. The user interface (220) may enable the liquid dispensing device (100) to present information to a user and receive input from the user.

The liquid dispensing device may also include identification systems (220), a liquid extraction system (230), and a liquid preservation system (240). Each of the components is described below.

The identification system (220) may identify containers of liquids and liquid receptacles. A container of liquid may be, for example, a bottle of wine and a liquid receptacle may be, for example, a wine glass. When a container is inserted into a liquid dispensing device (100), a liquid container identification sensor (222) may identify a type of liquid included in the container. The liquid container identification sensor (222) may also monitor a quantity of liquid inside the container as the liquid is dispensed. The liquid container identification sensor (222) may be a physical component such as, for example, a camera. The liquid container identification sensor (222) may also include an interrogation source, such as a light source, that facilitates measurements by the sensor. Refer to FIG. 4 for additional details regarding the liquid container identification sensor (222).

Figure 3A:
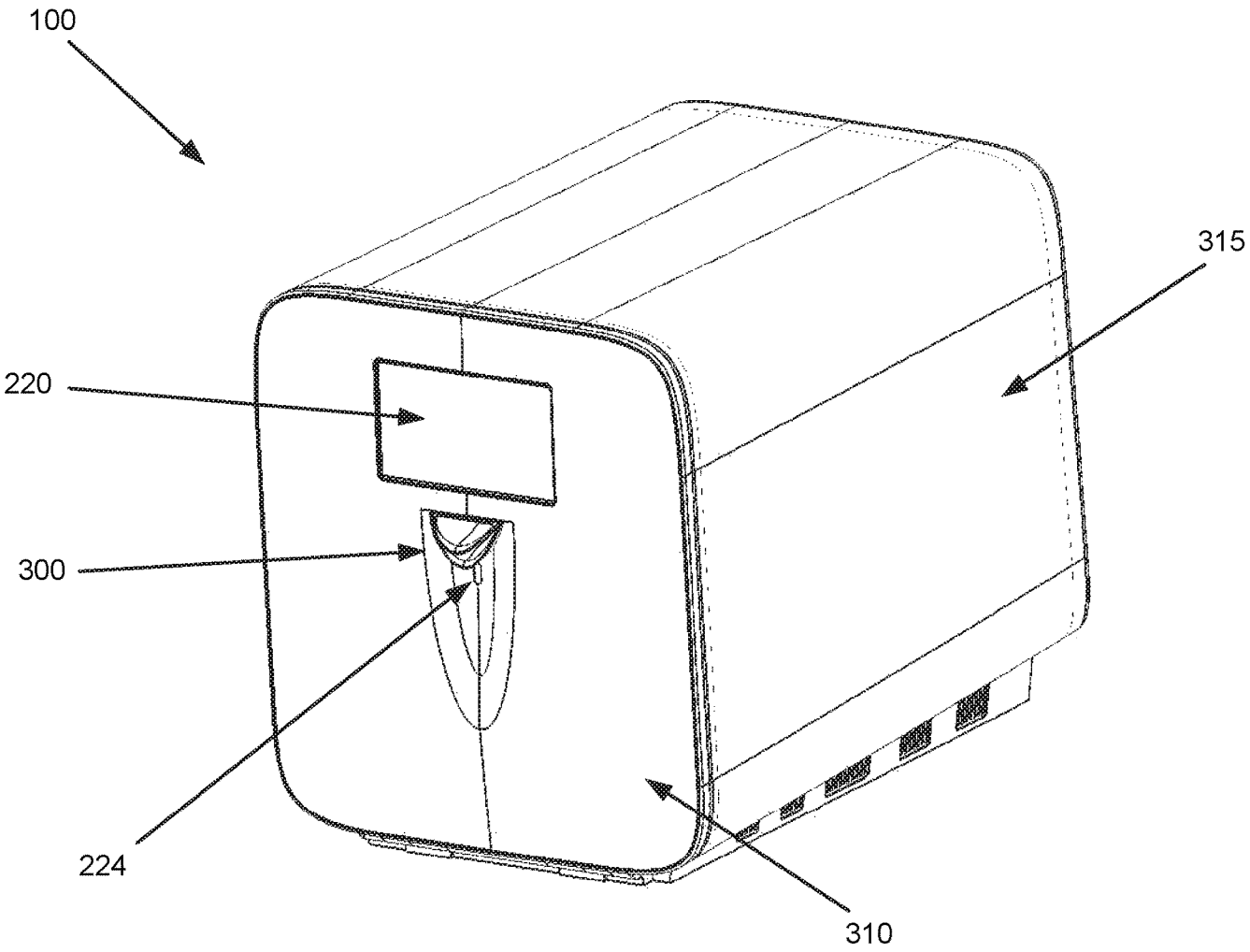
FIG. 3A shows an isometric diagram of a liquid dispensing device in accordance with one or more embodiments of the invention.

Additionally, when a liquid dispensing device is instructed to dispense a liquid, a liquid receptacle identification sensor (224) may determine whether a receptacle is in the dispensing area. By determining whether a receptacle is in the dispensing area, the liquid dispensing device (100) may prevent spills of liquid by not dispensing the liquid when a receptacle is not in the dispensing area. The liquid receptacle identification sensor (224) may be a physical component such as, for example, a camera, a capacitive sensor, a distance sensor, an ultrasonic sensor, or any other type of sensor for detecting the presence of a physical object. Refer to FIG. 3A for additional details regarding the liquid container identification sensor (222).

The liquid extraction system (230) may extract liquids from a container in response to requests from a user. The liquids may be extracted automatically and may prevent the remaining liquids from being exposed to an ambient environment. Additionally, the liquid extraction system (230) may meter dispensed liquids to determine consumption habits of users. The liquid extraction system (230) may include a penetration device (232), a liquid container holding device (234), and a liquid metering device (236). Each of the components is described below.

The penetration device (232) may configured to penetrate a portion of a container. In one embodiment of the invention, the penetration device, after penetrating the portion of the container, remains within the container until all or substantially all of the liquid is extracted from the container. The penetration device may also be removed after penetrating the portion of the container if the container is to be removed from the liquid dispensing device before all or substantially all of the liquid is extracted from the container. The portion of the container may be, for example, a closure of the container. Non-limiting examples of closures include corks, screw tops, or other closure devices or component of a wine bottle. After penetration, liquids may be extracted using the penetration device (232). Refer to FIGS. 5A-6F for additional details regarding the penetration device (232).

The liquid container holding device (234) may be a physical structure for holding a container including a liquid. The liquid container holding device (234) may be configured to press the container against the penetration device (232) to penetrate the container. Refer to FIGS. 4A-5B for additional details regarding the liquid container holding device (234).

The liquid metering device (236) may be a physical component for metering liquids being dispensed by the liquid dispensing device. The metering device (236) may be, for example, a flow meter. Liquid extracted from a container may flow through the liquid metering device (236) before being dispensed and enable specific quantities of liquid to be dispensed. Refer to FIG. 5C for additional details regarding the liquid metering device (236).

The liquid preservation system (240) may preserve a quality of a liquid disposed within a container. The liquid preservation system (240) may control both atmospheric and thermal conditions of a liquid to preserve a quality of the liquid. The liquid preservation system (240) may include a thermal regulation device (242) and an atmospheric regulation device (244). Each of the components is described below.

Figure 4A:
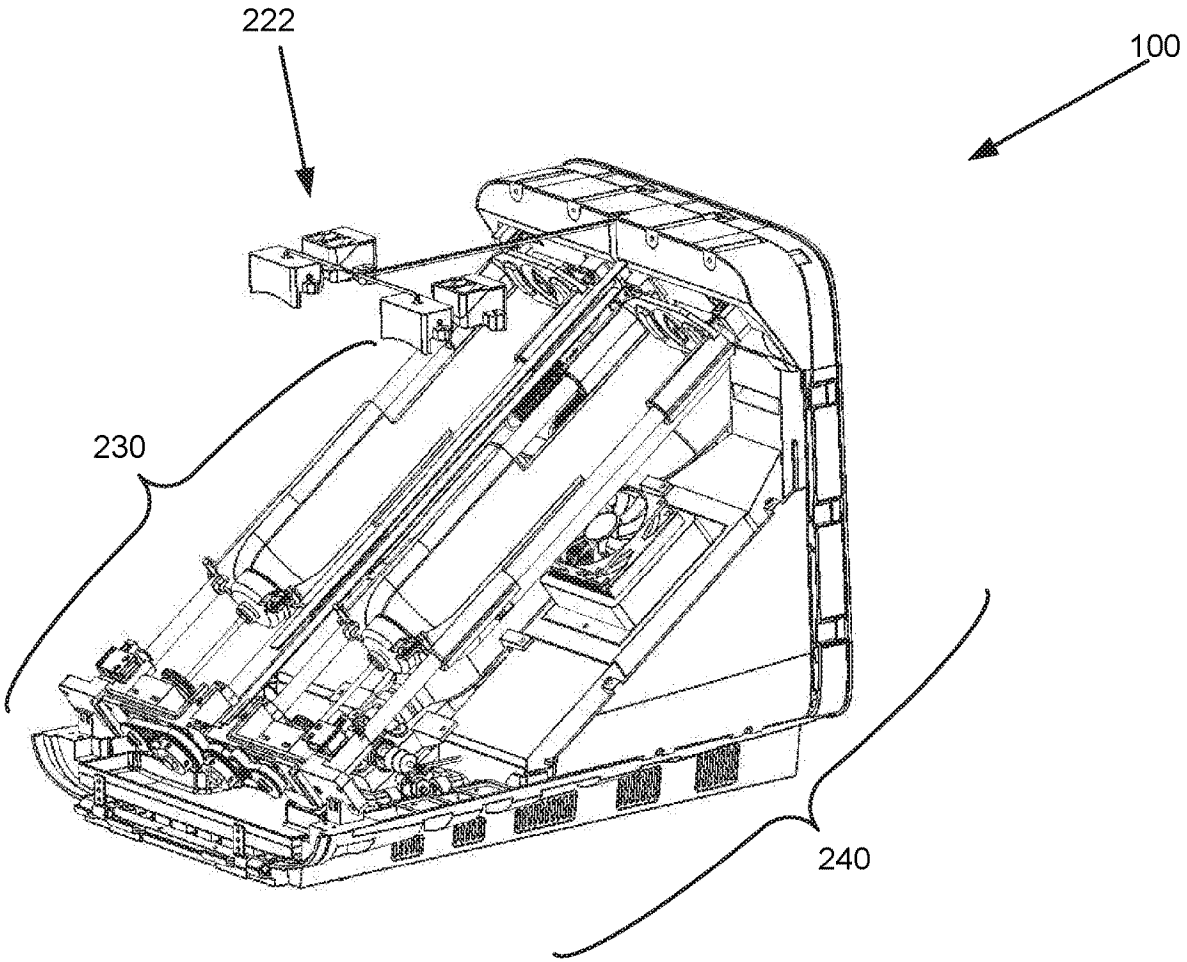
FIG. 4A shows a second isometric diagram of a liquid dispensing device in accordance with one or more embodiments of the invention.
Figure 4B:
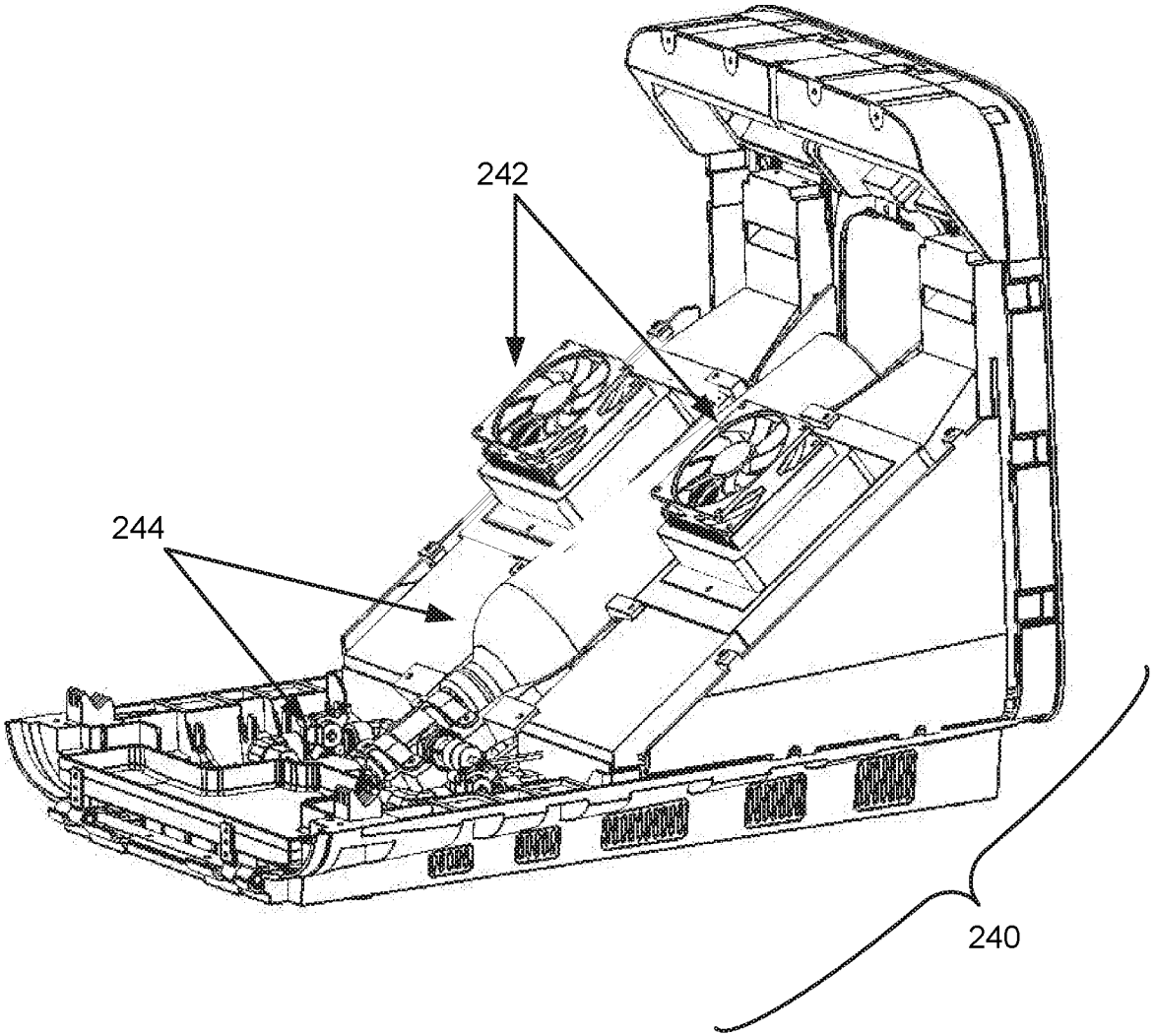
FIG. 4B shows a third isometric diagram of a liquid dispensing device in accordance with one or more embodiments of the invention.

The thermal regulation device (242) may be a physical component for regulation of temperature. The thermal regulation device (242) may include, for example, an air conditioning system, a heat pump, a heat exchanger, and/or a peltier cooler. In some embodiments of the invention, the thermal regulation device (242) may be a valve connected to an external source of temperature controlled air provided by a source other than the liquid dispensing device. The thermal regulation device (242) may also include one or more temperature sensors. The thermal regulation device (242) may generate an airflow to regulate a temperature of a liquid within a container at a predetermined temperature. The thermal regulation device (242) may measure a temperature of the liquid using the one or more temperature sensors and modify a temperature and/or a flow rate of the generated air flow based on the temperature of the liquid. In one or more embodiments of the invention, the thermal regulation device (242) may maintain a temperature of the liquid based on a type of the liquid disposed in the container. Refer to FIGS. 4A and 4B for additional details regarding the thermal regulation device (242).

The atmospheric regulation device (244) may be a physical component for regulation of an atmosphere within a container. The atmospheric regulation device (244) may include, for example, a gas source and a pressure regulator. The gas source may be, for example, a pressurized container of gas. In some embodiments of the invention, the gas source may be an external source such as, for example, a gas supply of a building. The atmospheric regulation device (244) may inject a gas into the container via the liquid penetration device. A pressure of the gas may be maintained via the pressure regulator, where maintaining the pressure prevent oxygen from entering the container and being dissolved within the liquid in the container. In one or more embodiments of the invention, the atmospheric regulation device (244) may maintain a pressure of the gas based on a type of liquid disposed in the container. Refer to FIGS. 4A-4B for additional details regarding the atmospheric regulation device (244).

FIG. 3A shows an isometric diagram of a liquid dispensing device (100) in accordance with embodiments of the invention. The liquid dispensing device (100) includes an internal volume, accessible by a door (310) for holding one or more containers including liquid. The internal volume is surrounded by a shell (315) that obscures the containers from the view of a user when the containers are in the liquid dispensing device (100).

A user interface (220) is included on the door (310). The user interface (220) enables information to be communicated to a user of the device and/or enables a user to input information to the liquid dispensing device (100). The user interface (220) may be, for example, a touch sensitive display. Images corresponding to the types of liquid included in containers within the liquid dispensing device (100) may be displayed to the user via the user interface (220). Touch sensitive portions of the user interface (220) may enable a user to request that a liquid be dispensed from the liquid dispensing device (100). A specific quantity of liquid may be specified for dispensing.

While the user interface (220) is illustrated as being disposed on the door, the user interface (220) may be disposed on other portions of the liquid dispensing device (100) without departing from the invention. Additionally, the user interface (220) may be disposed on a separate device without departing from the invention. The separate device may be, for example, a tablet computer, point of sale terminal, or other type of computing device. The separate device may operate as a thin client for the liquid dispensing device (100) or otherwise enable communication between the user and the liquid dispensing device (100).

One or more spouts may also be disposed on the door (310). Liquids that are extracted from containers disposed within the liquid dispensing device (100) may be dispensed into a receptacle via the spouts. In one or more embodiments of the invention, the spouts (300) are made of plastic, wood, metal, or a combination of the aforementioned materials. In one or more embodiments of the invention, decorative elements of the spouts (300) such as a hood or other cover may be made of wood while the components of the spouts (300) that directly interface with a fluid are made of plastic. In one or more embodiments of the invention, the spouts (300) are made of wood. While illustrated in FIG. 3A as being disposed on the door, the spouts (300) may be disposed on other portions of the liquid dispensing device (100) without departing from the invention.

Figure 3C:
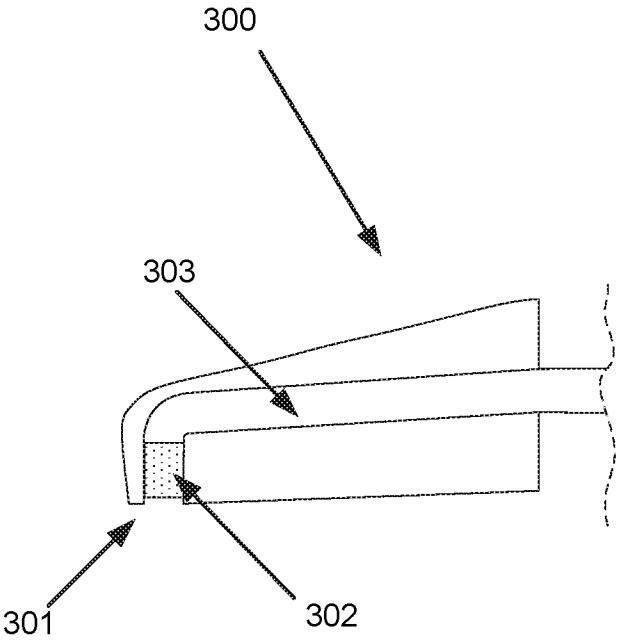
FIG. 3C shows a cross sectional diagram of the spout shown in FIG. 3B in accordance with one or more embodiments of the invention.
Figure 3B:
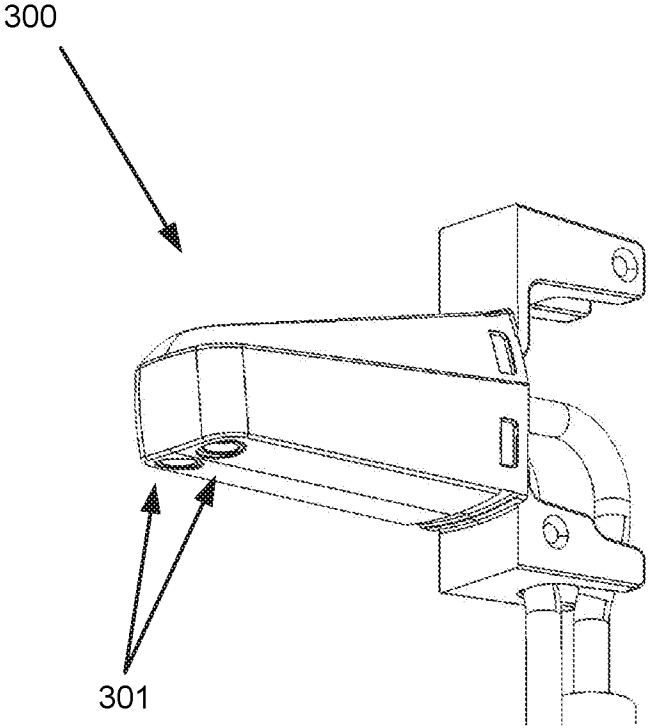
FIG. 3B shows an isometric diagram of a spout in accordance with one or more embodiments of the invention.

FIG. 3B shows a isometric diagram of a spout (300) in accordance with one or more embodiments of the invention. The diagram in FIG. 3B illustrates mechanical components of the spout (300) that enable liquid to be dispensed by the spout (300). The spout (300) may include decorative items (not illustrated) such as a cover or hood that improve the appearance of the spout (300) or hide mechanical features of the spout (300) without departing from the invention.

In one or more embodiments of the invention, the spout (300) may project outward, away from the door (310), to enable a receptacle to be placed under the spout to receive a fluid extracted from a container disposed with the liquid dispensing device. The spout may be made of plastic, metal, ceramic, or a combination of the aforementioned materials. The spout may be made out of other materials without departing from the invention. In one or more embodiments of the invention, the spout may be coated in a hydrophobic or food safe coating. The coating may reduce the likelihood of fluids dispensed by the spout from being contaminated by the spout, or residual materials on the spout from previously disposed fluids, and/or reduce the likelihood of a fluid leaving a residue or contaminant on the spout when/after being dispensed.

The spout may include at least two liquid dispensing ports (301). Each port may be hydraulically connected to a corresponding container when fluids are being dispensed from the corresponding container. The spout may include greater or lesser numbers of ports (301) without departing from the invention.

FIG. 3C shows a cross sectional diagram of the spout along an internal length of the spout that hydraulically connects one of the ports (301) to a container (not shown). The spout (300) may include a pressure actuated stopper (302) near a port (301) along the hydraulic path (303) connecting the port (301) to the container. The pressure actuated stopper (302) may seal the hydraulic path (303) when a fluid pressure on a container-side of the pressure actuated stopper (302) along the hydraulic path (303) is less than a predetermined amount. The pressure actuated stopper (302) may open the hydraulic path (303) to permit fluid flow when the fluid pressure on the container-side of the pressure actuated stopper (302) along the hydraulic path (303) is greater than the predetermined amount. In one or more embodiments of the invention, the predetermined amount may be an ambient pressure or greater than the ambient pressure so that the pressure actuated stopper (302) seals the hydraulic path (302) unless fluid is pumped or pressurized on the container-side of the pressure actuated stopper (302).

While not shown in FIGS. 3B-C, the spout (300) may include other structural components or adapter attachment points. For example, the nozzle (300) may include an aerator or adapter attachment point for attachment of an aerator. The aerator may modify the characteristics of the fluid dispensed by the nozzle by injecting a gas into the fluid or mixing the fluid with a gas before dispensing the fluid. The adapter attachment points may be a set of threads, pins, or other mechanical interlocking structure for fixedly attaching a device to the spout (300).

Returning to FIG. 3A, a liquid receptacle identification sensor (224) may be disposed on the door (310). The liquid receptacle identification sensor (224) may be a physical component for determine whether a receptacle is present to receive liquid dispensed by the liquid dispensing device (100). The liquid receptacle identification sensor (224) may be, for example, a camera, a distance sensor, an ultrasonic sensor, a capacitive device, or a proximity sensor. The liquid receptacle identification sensor (224) may be other sensors without departing from the invention. While illustrated in FIG. 3A as being disposed on the door, the liquid receptacle identification sensor (224) may be disposed on other portions of the liquid dispensing device (100) without departing from the invention.

FIG. 4A shows an isometric diagram of the liquid dispensing device (100) in accordance with embodiments of the invention. In FIG. 4A, the door (310) and shell (315) are removed. Additionally, insulation and other materials used to reduce heat transfer and noise generation are also removed to better illustrate addition components of the liquid dispensing device (100).

The liquid dispensing device (100) includes a liquid extraction system (230). The liquid extraction system receives containers of liquid and automatically extracts liquid from the containers in response to requests from users.

The liquid dispensing device (100) includes a liquid container identification sensor (222). The liquid container identification sensor (222) may be a physical component for determine type of liquid disposed in a container. The liquid container identification sensor (222) may be, for example, a camera. The camera may generate an image of the container. The type of liquid may be determined using the image of the container.

FIG. 4B shows an isometric diagram of the liquid dispensing device (100) in accordance with embodiments of the invention. In FIG. 4B, the door (310), shell (315), and liquid extraction system (230) are removed. Additionally, insulation and other materials used to reduce heat transfer and noise generation are also removed to better illustrate addition components of the liquid dispensing device (100).

The liquid dispensing device (100) includes a liquid preservation system (240). The liquid preservation system (240) may include thermal regulation device(s) (242) and an atmospheric regulation device (244). Each of the aforementioned devices may be disposed within the internal volume of the liquid dispensing device (100).

The atmospheric regulation device(s) (244) may include a gas source and one or more gas flow and gas pressure regulators. Gas may be supplied from the source to the regulators and, in turn, to a container to maintain an atmospheric environment within the container.

The thermal regulation device(s) (242) may include heating units, chilling units, fans, heat exchangers, and/or other devices to facilitate regulating a temperature of a liquid disposed in a container at a desired temperature.

Figure 5A:
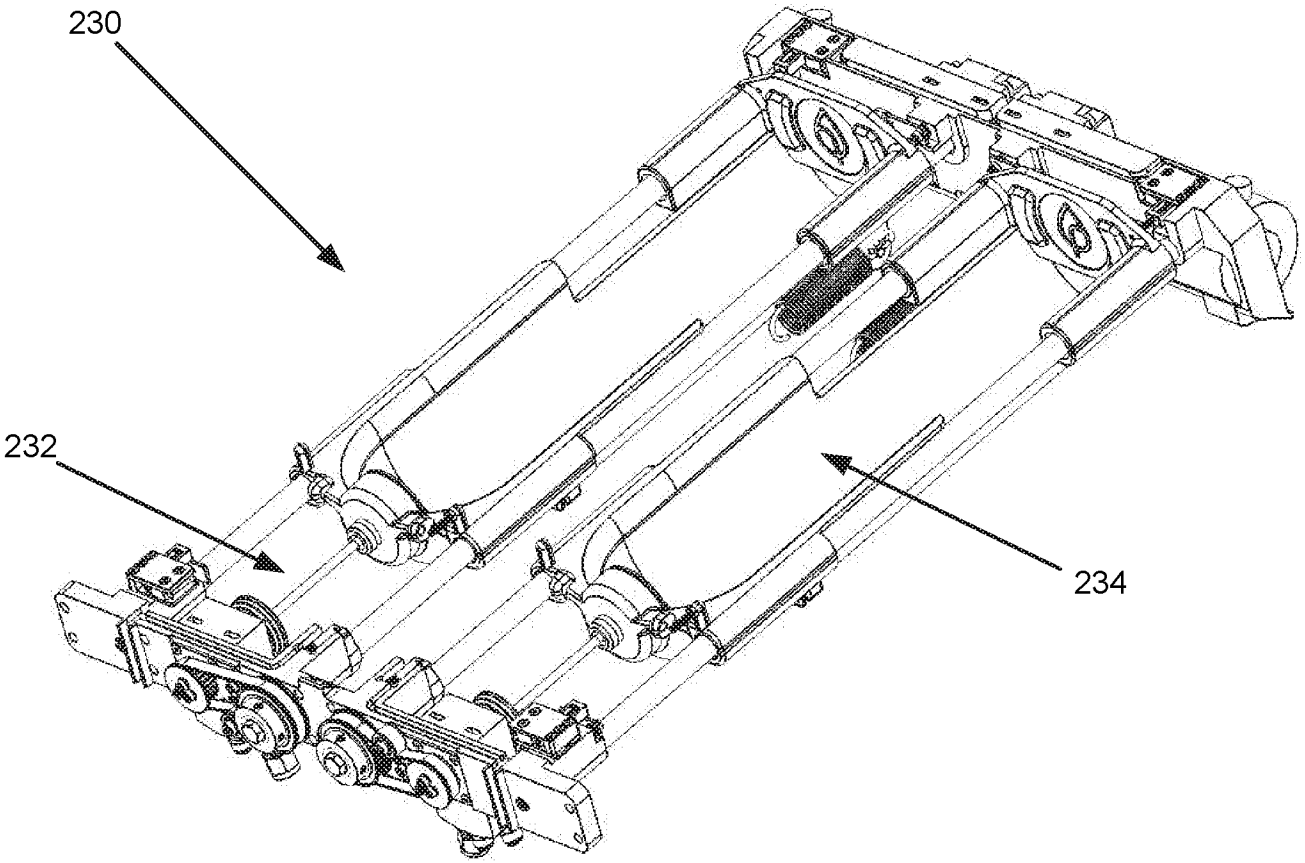
FIG. 5A shows an isometric diagram of a liquid extraction system in accordance with one or more embodiments of the invention.

FIG. 5A shows an isometric diagram of a liquid extraction system (230) in accordance with embodiments of the invention. The liquid extraction system (230) includes a liquid container holding device (234) for receiving and holding of containers of liquid, a penetration device (232) for penetrating containers, and a liquid metering device (not shown) for metering of liquids extracted from containers. The liquid container holding device (234) and penetration device (232) may operate cooperatively to penetrate and extract liquids from a container.

Figure 5B:
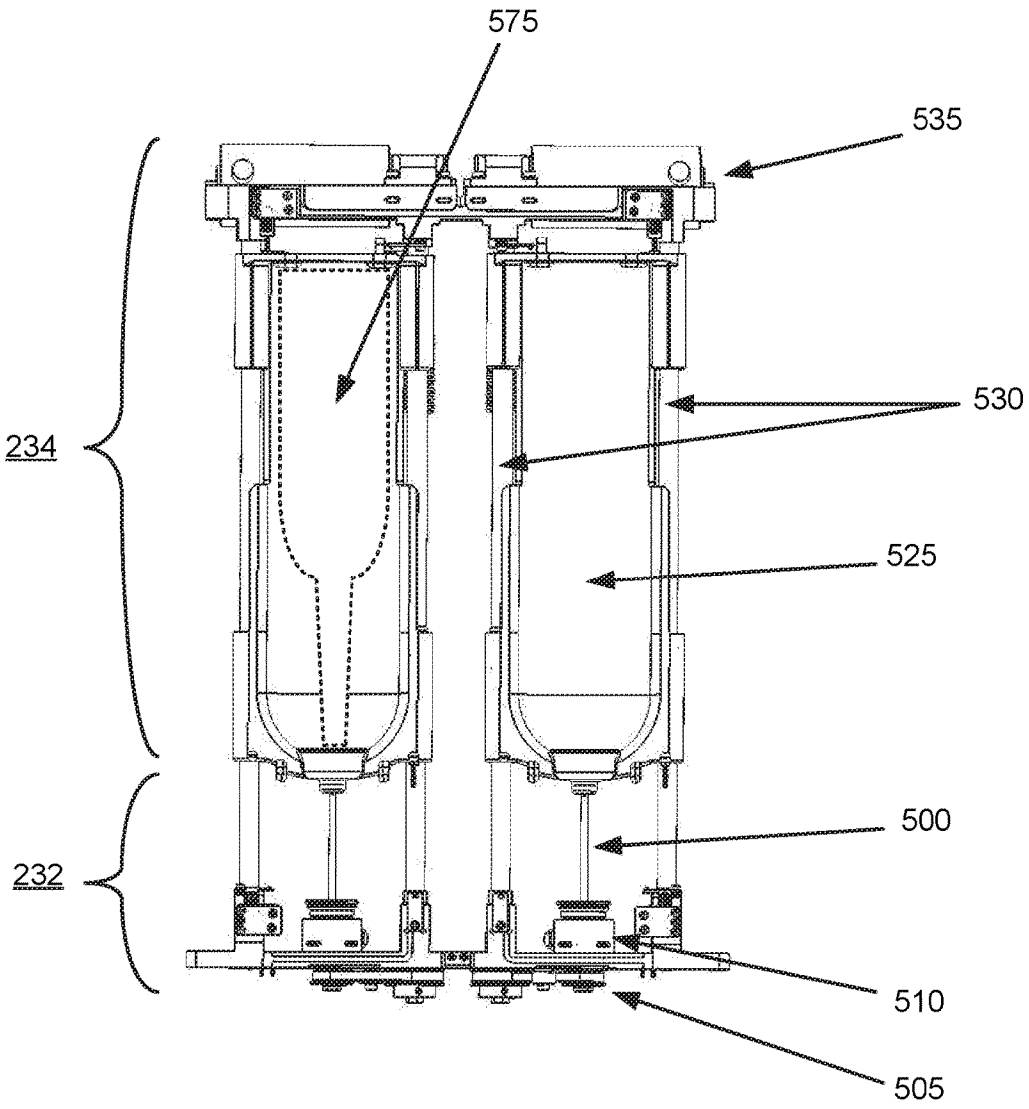
FIG. 5B shows a top view diagram of a liquid extraction system in accordance with one or more embodiments of the invention.
Figure 5C:
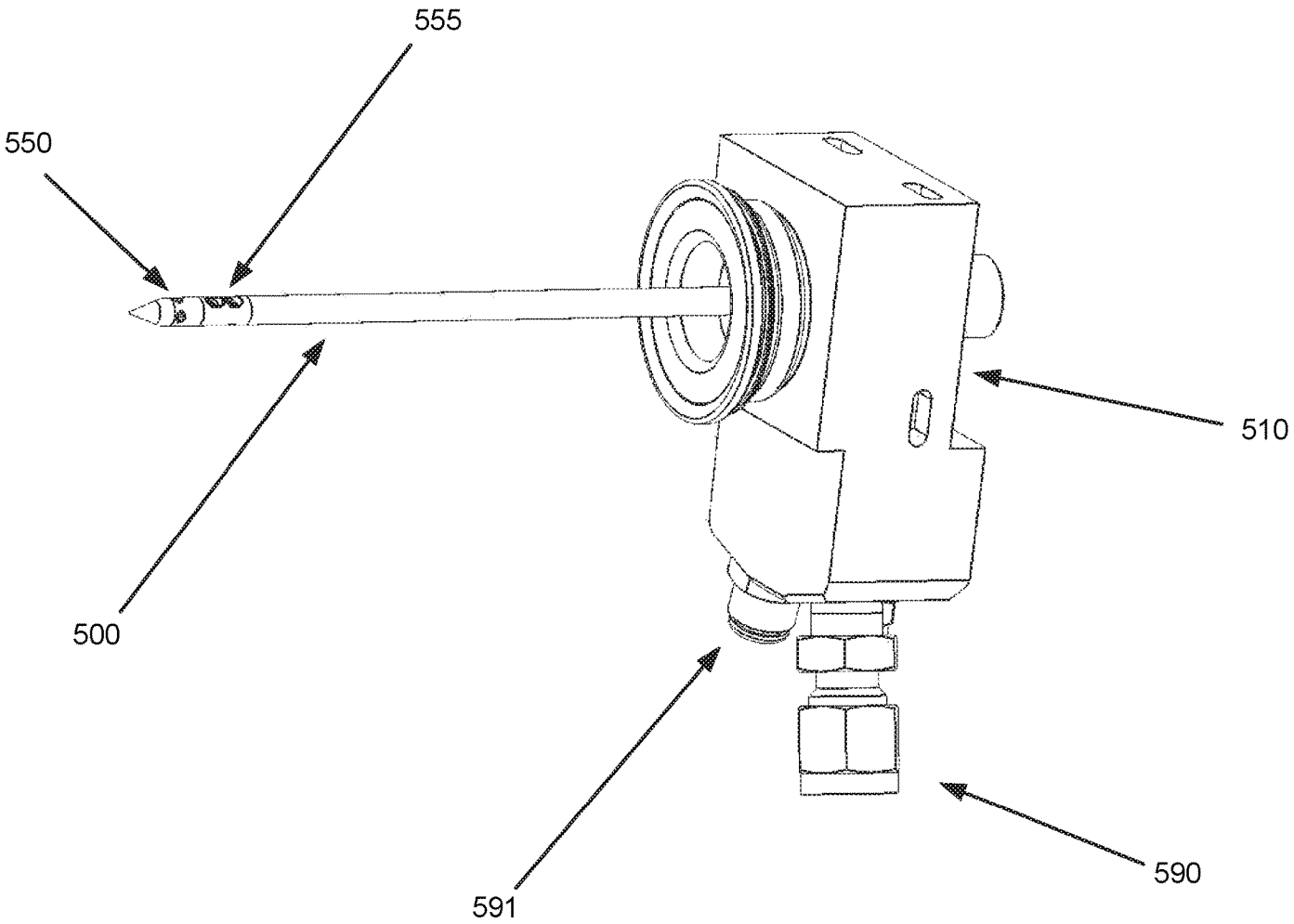
FIG. 5C shows an isometric diagram of a needle and manifold in accordance with one or more embodiments of the invention.

FIG. 5B shows a top view diagram of the liquid extraction system (230) shown in FIG. 5A. As seen from FIG. 5B, the liquid container holding device (234) includes a platform (525) mounted on sliding rails (530). The platform (525) may be connected to a linear actuator (535) that controls a location of the platform along the length of the sliding rails. Though not shown in FIG. 5B, the liquid container holding device (234) may include a sealing cup as a secondary seal around the closure of the container. Such a sealing cup may provide additional protection against liquid leakage from the container after the closure has been penetrated by the penetration device. The sealing cup may be a gasket, a faring, or any other sealing component.

The penetration device (232) may include a needle (500) for penetrating a container, a manifold (510) for controlling the flow of liquids, and a rotatory actuator (505). The needle (500) may be connected to the rotary actuator (505). The rotary actuator (505), when operating, may cause the needle (500) to rotate.

In one or more embodiments of the invention, the penetration device (232) may include a cyclical actuator (not shown). The cyclical actuator may cause the needle (500) to oscillate along a path while penetrating a container. In one or more embodiments of the invention, the path may be aligned with the length of the needle, may be perpendicular to the length of the needle, or may be oblique to the length of the needle. Causing the needle to oscillate along a path while penetrating the container may cause the needle (500) to vibrate during penetration of the container. Vibrating the needle (500) during penetration may reduce the likelihood of debris being deposited into the needle (500). Vibrating the needle (500) during penetration may reduce the likelihood of the needle (500) bending, or otherwise permanently deforming, during penetration. Vibrating the needle (500) during penetration may reduce the friction between the needle (500) and the container during penetration. Vibrating the needle (500) during penetration may reduce the likelihood of portions of the container shearing off and thereby breaking a seal between the container and the needle (500) during and/or after penetration.

In one or more embodiments of the invention, the cyclical actuator includes a cam, i.e., a rotating or sliding piece in a mechanical linkage, that is mechanically linked to the needle (500). The cam may be mechanically linked to the needle (500) via a cam follower that converts the rotational motion of the cam to a reciprocating linear motion. The cam may be mechanically coupled to a motor. The motor may be an electrical, pneumatic, or any other type of motor that rotates the cam.

In one or more embodiments of the invention, the cyclical actuator includes an elliptical channel that causes the needle (500) to vibrate while the needle (500) penetrates a container. The vibrations generated by the elliptical channel may be aligned with the length of the needle, perpendicular to the length of the needle, or obliquely to the length of the needle without departing from the invention.

In one or more embodiments of the invention, the cyclical actuator includes an ultrasonic transducer that is mechanically coupled to the needle (500) that causes the needle (500) to vibrate while the needle (500) penetrates a container. The vibrations may be aligned with the length of the needle, perpendicular to the length of the needle, or obliquely to the length of the needle (500) without departing from the invention.

While not shown, the manifold (510) may include a mechanical coupler that allows the needle to vibrate during penetration of the container. The mechanical coupler may be, for example, one or more longitudinal couplers. Each longitudinal coupler may allow the needle to vibrate along the axis of the longitudinal coupler. The mechanical coupler may be a different type of coupler without departing from the invention.

The needle (500) may include multiple passages by which liquids may traverse a length of the needle (500) the passages may be connected to the manifold (510) to direct the flow of liquids leaving each passage.

An example container (575) is also shown in FIG. 5B. As seen from FIG. 5B, the example container (575) is disposed on a platform. To extract liquids from the example container (575), the linear actuator (535) may be activated to move the platform toward the penetration device (232). Moving the platform may press a portion of the example container (575) against the needle (500). For example, the container may be a wine bottle having a closing device such as a cork, screw top, or other structure for sealing the bottle. The closing device may be a natural material, a manmade material, or any other type of material. The wine bottle may be placed on the platform so that the cork is adjacent to the needle (500).

While the example container (575) is pressed against the needle, the rotary actuator may be activated to cause the needle (500) to rotate. Rotating the needle (500) while pressing against the example container (575) may be easily and reproducibly cause the needle (500) to penetrate through the example container (575). Once the needle (500) has penetrated into the example container (575), liquid may be extracted from the container (575) as will be further described with respect to FIGS. 5C-6F.

FIG. 5C shows an isometric diagram of a needle (500) and a manifold (510) in accordance with embodiments of the invention. The needle (500) and manifold (510) may operate cooperatively to extract liquids from a container and regulate atmospheric conditions within the container.

The needle (500) may include injection ports (550) and extraction ports (555). Each of the ports may be disposed near a first end of the needle (500). The ports may be used to inject gasses and extract liquids, respectively, from a container when the needle (500) has penetrated the container.

The manifold (510) may be disposed at the end of the needle away from the ports. The manifold (510) may be a physical component that directs the flow of liquids into and out of the injection ports (550) and the extraction ports (555). Additionally, the manifold (510) may incorporate a rotary coupling so that the needle may be rotated by the rotary actuator.

The manifold (510) may include an atmospheric regulation device port(s) (591) for connecting of the injection ports (550) to the atmospheric regulation device and a liquid metering device port (590) for connecting of the extraction ports (555) to the liquid metering device.

Figure 6A:
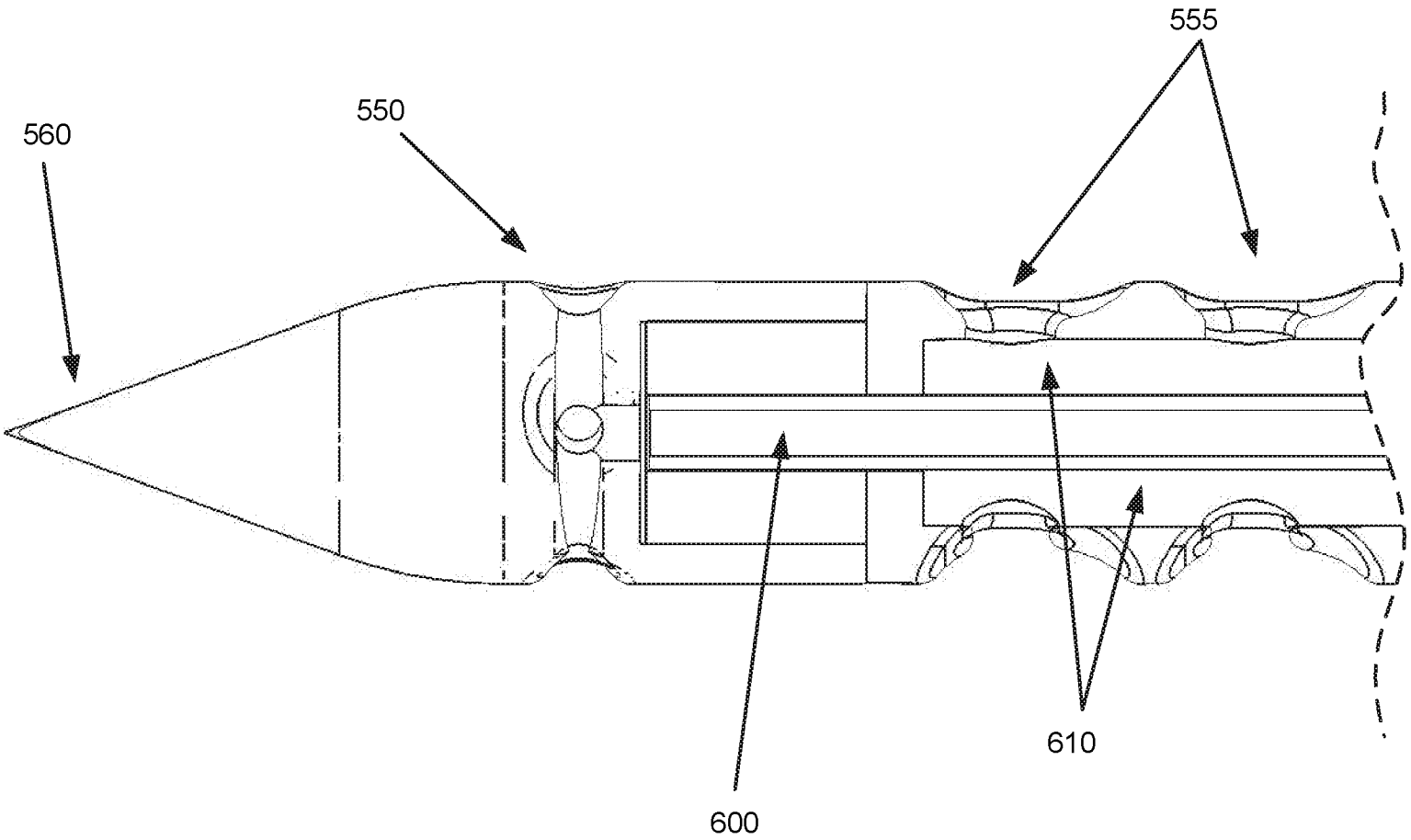
FIG. 6A shows a cross section view diagram of a needle in accordance with one or more embodiments of the invention.

FIG. 6A shows a cross section diagram of the needle (500) shown in FIG. 5C. As seen from FIG. 6A, needle (500) includes an injection passage (600), connected to the injection ports (550), and an extraction passage (610), connected to the extraction ports. Each of the passages separately connect to the manifold. The injection ports (550) and/or extraction ports (555) may be disposed adjacent to a first end of a length of the needle (500) near a point (560) of the needle. The point of the needle (560) may be the surface that is designed to penetrate containers.

While the needle (500) is illustrated in FIGS. 5C and 6A as having four injection ports (550), four extraction ports (555), a flat exterior, and coaxially aligned passages, numerous variations are possible without departing from the invention. FIGS. 6B-6M show examples of needles in accordance with embodiments of the invention.

Figure 6B:
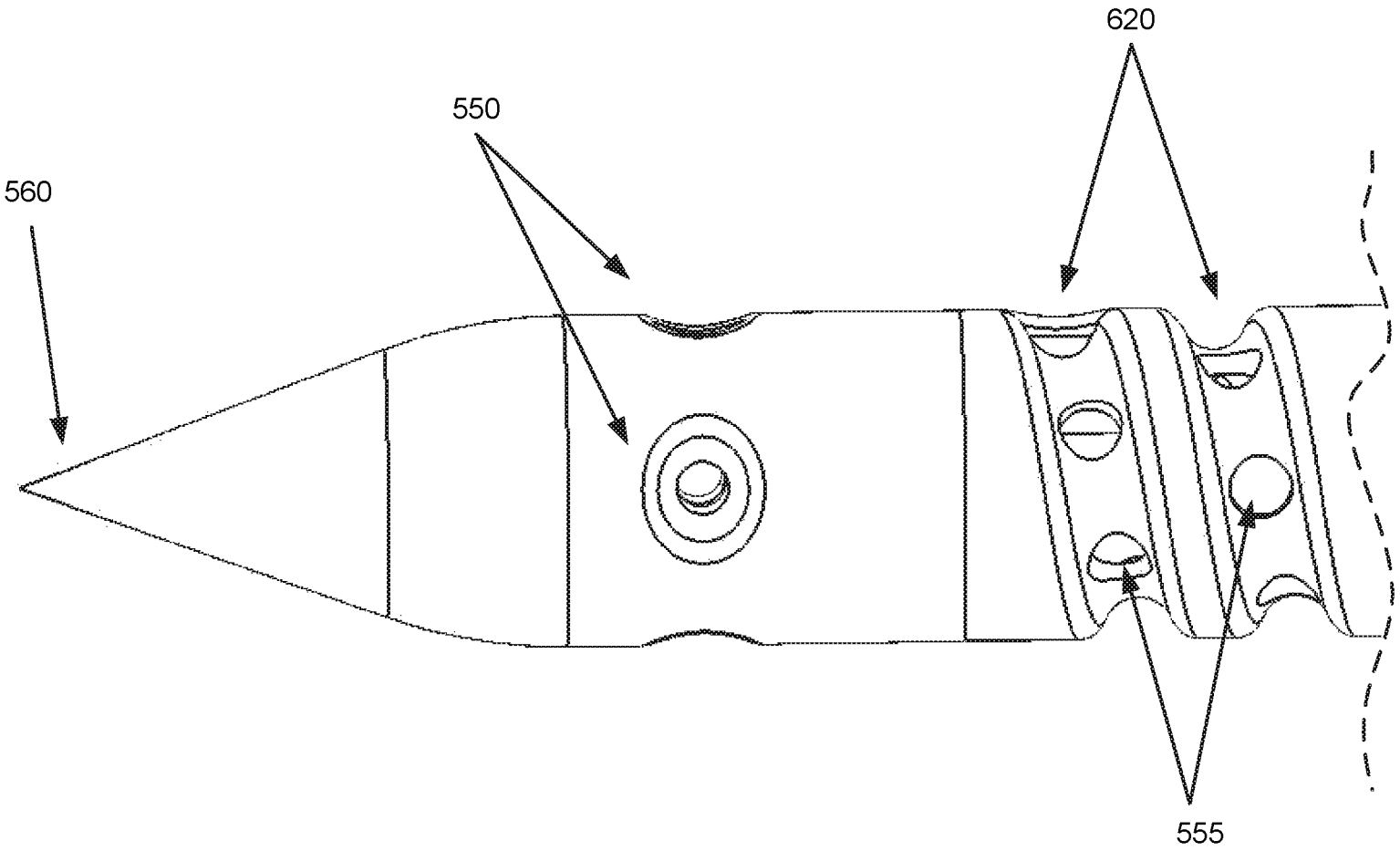
FIG. 6B shows an example of a needle in accordance with one or more embodiments of the invention.

FIG. 6B shows a first example of a needle in accordance with embodiments of the invention. The first example is similar to the needle (500) shown in FIGS. 5C and 6A. The first example needle includes extraction ports (555) disposed in a recessed, spiral groove (620). Disposing the extraction ports (555) in groove (620) may prevent debris from blocking the extraction ports (555). Additionally, distributing the ports around the cylindrical surface may also reduce the chance of debris blocking all of the extraction ports (555). The recess may follow a helical path along a length of the needle and along the outer surface of the needle. The debris may be generated when the needle penetrates a container.

Figure 6C:
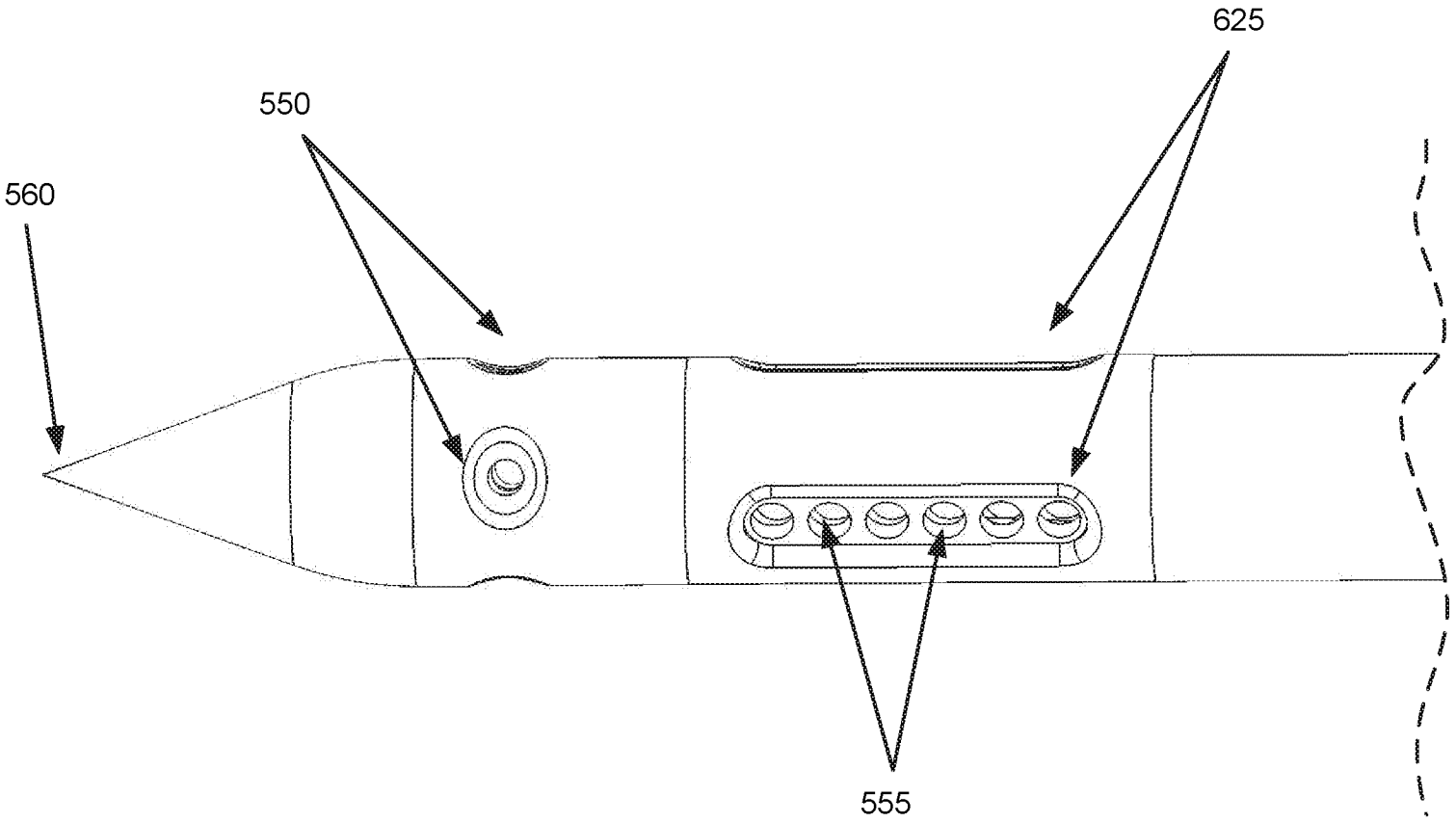
FIG. 6C shows a second example of a needle in accordance with one or more embodiments of the invention.

FIG. 6C shows a second example of a needle in accordance with embodiments of the invention. The second example is similar to the needle (500) shown in FIGS. 5C and 6A. The second example needle includes extraction ports (555) disposed in a recessed groove (625). The recessed groove may be disposed along an insertion direction of the needle. The insertion direction may be along a length of the needle. Disposing the extraction ports (555) in a recessed groove (625) may prevent debris from blocking the extraction ports (555). Additionally, producing a recessed groove (625) disposed along an insertion direction may be more cost effective than the recessed, spiral groove (620, FIG. 6B).

Figure 6D:
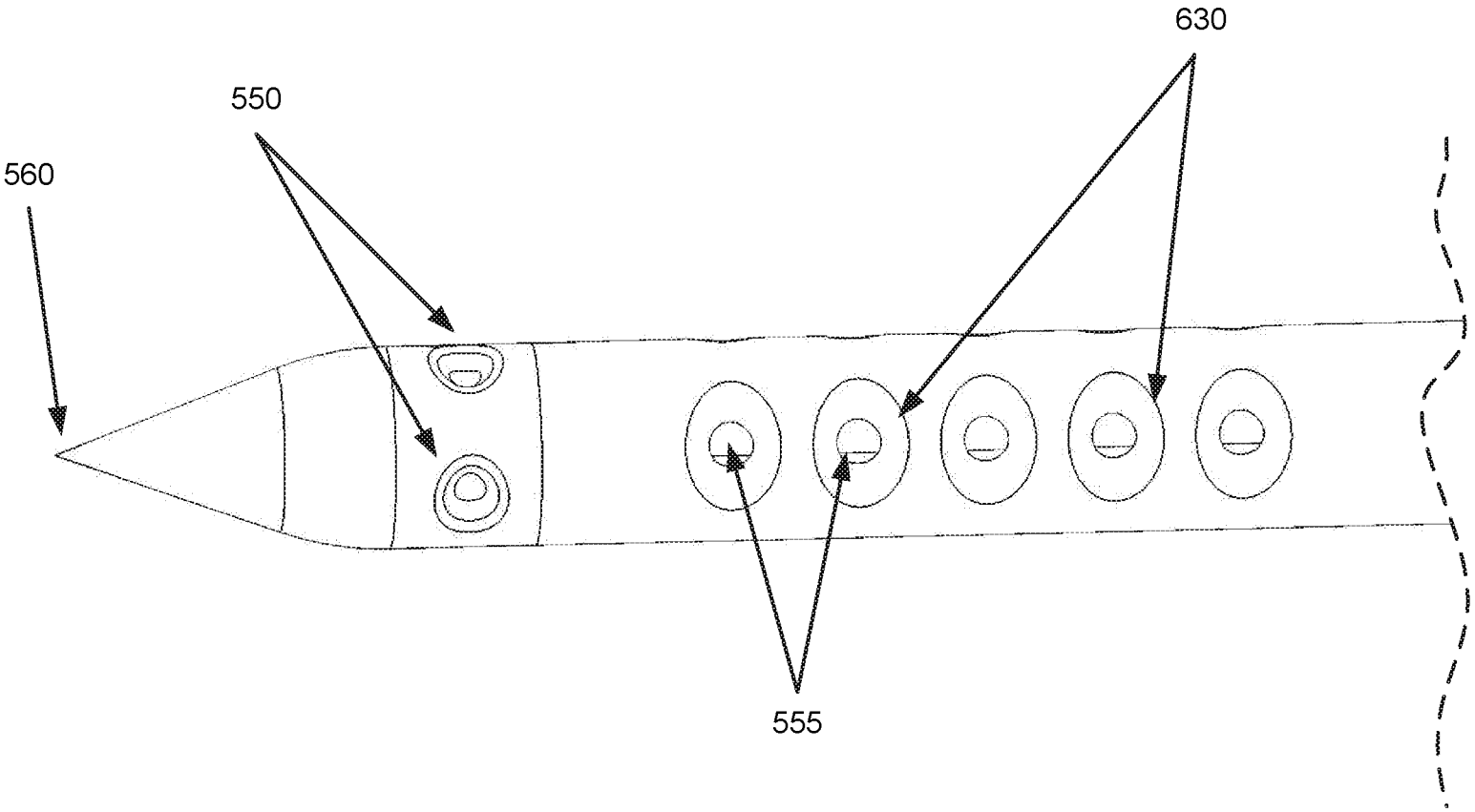
FIG. 6D shows a third example of a needle in accordance with one or more embodiments of the invention.

FIG. 6D shows a third example of a needle in accordance with embodiments of the invention. The third example is similar to the needle (500) shown in FIGS. 5C and 6A. The third example needle includes extraction ports (555) formed by punching through an outer wall of the needle. Punching may be more cost effective than producing recesses as shown in FIGS. 6B-6C. Each of the extraction ports (555) may be disposed in separate punch depressions (630).

Figure 6E:
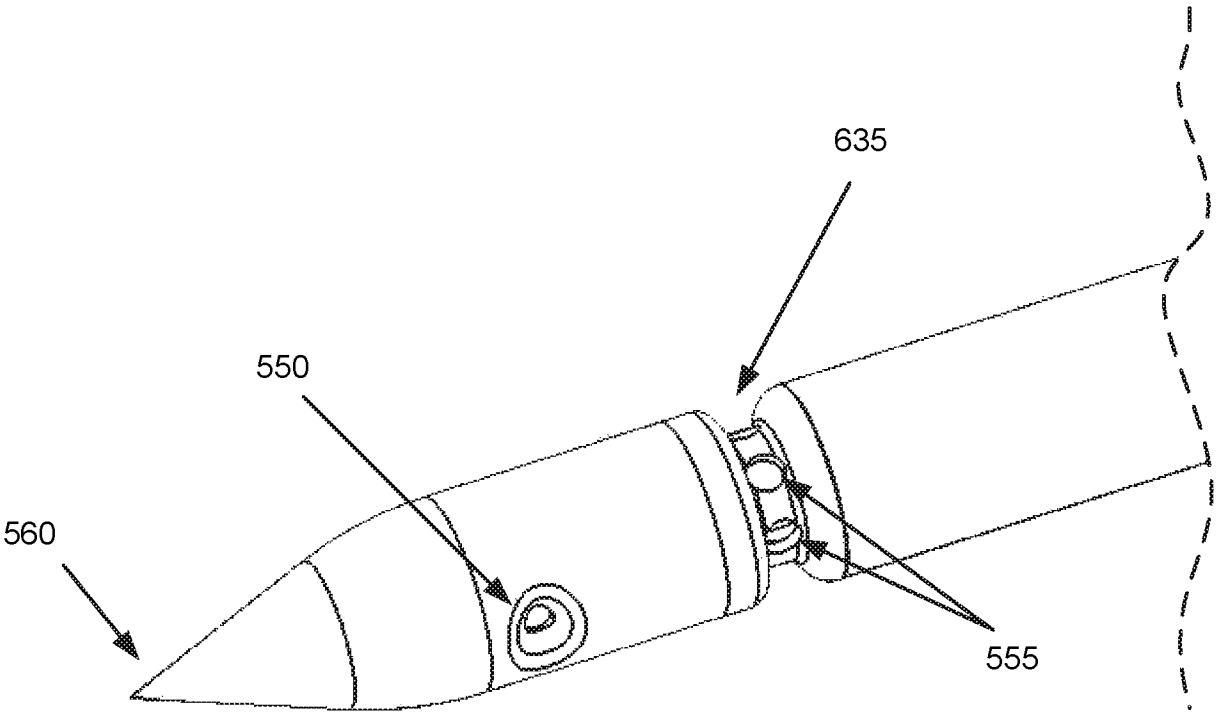
FIG. 6E shows a fourth example of a needle in accordance with one or more embodiments of the invention.

FIG. 6E shows a fourth example of a needle in accordance with embodiments of the invention. The fourth example is similar to the needle (500) shown in FIGS. 5C and 6A. The fourth example needle includes extraction ports (555) formed in a radial groove (635). Forming the extraction ports (555) in the radial groove may reduce the chance of debris blocking the extraction ports (555).

Figure 6F:
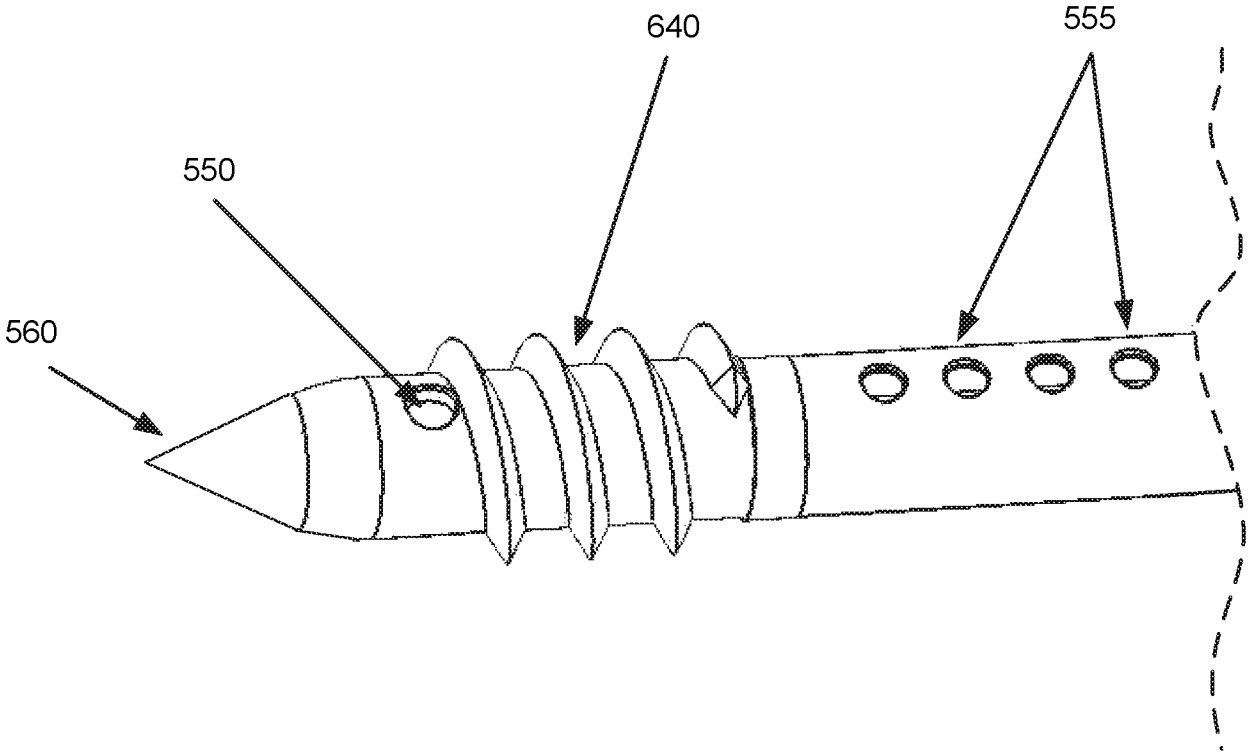
FIG. 6F shows a fifth example of a needle in accordance with one or more embodiments of the invention.

FIG. 6F shows a fifth example of a needle in accordance with embodiments of the invention. The fifth example is similar to the needle (500) shown in FIGS. 5C and 6A. The fifth example needle includes a liquid container engagement portion (640) configured to engage and/or drive the needle into the container. For example, the liquid container engagement portion (640) may be a screw. When the needle is rotated, the screw may engage the container driving the needle into or out of the container depending on the direction of rotation of the needle.

Figure 6G:
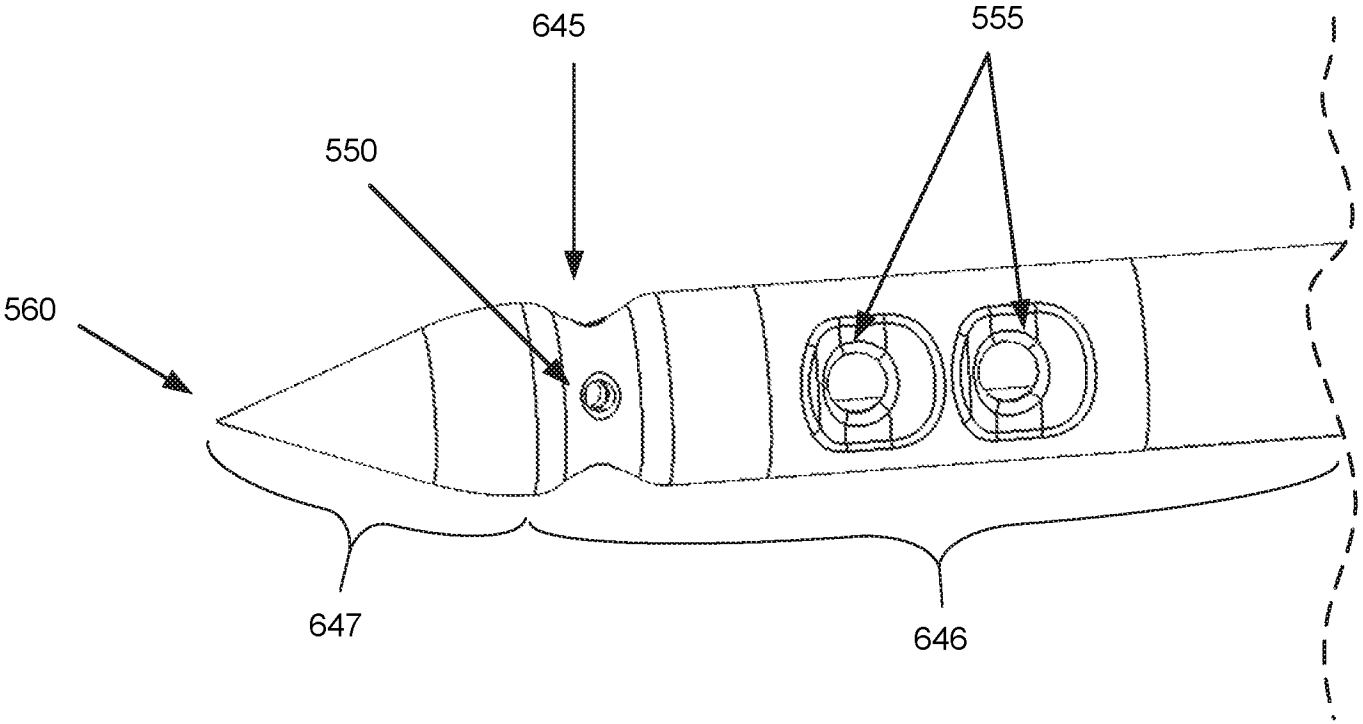
FIG. 6G shows a sixth example of a needle in accordance with one or more embodiments of the invention.

FIG. 6G shows a sixth example of a needle in accordance with one or more embodiments of the invention. The sixth example is similar to the needle (500) shown in FIGS. 5C and 6A. The sixth example needle includes a recessed portion (645) disposed between the point (560) and a length (646) of the needle. As used herein, the length (646) of the needle refers to the portion of the needle other than the point (560) and the tapering (647) of the point (560) from a point to circle having a diameter. In other words, the length of the needle may be of a cylindrical shape and have a diameter along the length of the needle.

In various embodiments, recessed portions or projected portions may be present along the length (646). As used herein, a recessed portion refers to a portion of the length of the needle that is recessed inward from a surface corresponding to the average diameter of the needle. Conversely, a projected portion refers to a portion of the length of the needle that is projected outward from the surface corresponding to the average diameter of the needle. The recessed portions and/or projected portions may have complex surface profiles. In other words, the recessed portion may have a shape that is more complicated than being merely a cylinder of a smaller diameter than the length. For example, the recessed portion may include regions that taper from the diameter of the length to a smaller diameter and then taper from the smaller diameter to the diameter of the length along the length of the needle. Similarly, a projected portion may include regions that taper from the diameter of the length to a larger diameter and then taper from the larger diameter to the diameter of the length along the length of the needle. A needle may include any number, quantity, and arrangement of recessed portions and/or projected portions without departing from the invention.

In various embodiments of the invention, injection ports (550) and/or extraction ports (555) may be disposed on the recessed portions and/or the projected portions. The injection ports (550) and/or extraction ports (555) may be disposed at other locations on the needle without departing from the invention.

Returning to FIG. 6G, the sixth example illustrates a needle in accordance with embodiments invention that includes injection ports (550) that are disposed within the recessed portion (645). By recessing the injection ports (550), the likelihood of tearing out a portion of the container while the needle is penetrating the container is reduced. Tearing out of a portion of the container may result in fluid leaking from the container, gasses leaking from the container, and/or debris becoming disposed in the injection or extraction passages of the needle.

During insertion of the needle into a container, the needle dislocates portions of the container, for example, a portion of a cork of a wine bottle, to create a passage through which the needle may traverse into the interior of the container. Containers are sometimes formed from materials that are elastic in nature and, therefore, a continuous pressure is applied to the needle by the container that attempts to close the passageway formed by the needle. The aforementioned continuous pressure is generally directed toward the center of the needle which results in the portion of the container dislocated by the needle being continuously pressed toward the center of the needle. As the needle passes through the container, the dislocated portion of the container may be pressed into ports or other recesses along the length of the needle. When pressed into the ports or other recesses, portions of the container may be torn off due to shear force exerted on the container by the port or recess of the needle as the needle traverses into or out of the container. The aforementioned torn off portions may become lodged in the ports, a passage way within the needle, or other portion of the liquid dispensing appliance and thereby disrupt the ability of the needle to extract fluids from the container.

One or more embodiments of the invention may reduce the likelihood of portions of the container being torn off during insertion of the needle into a container. Specifically, in one or more embodiments of the invention, injection ports and/or extraction ports may be disposed within recessed portions in a manner that reduces the likelihood of tearing of the container by the port and/or recess.

Figure 6H:
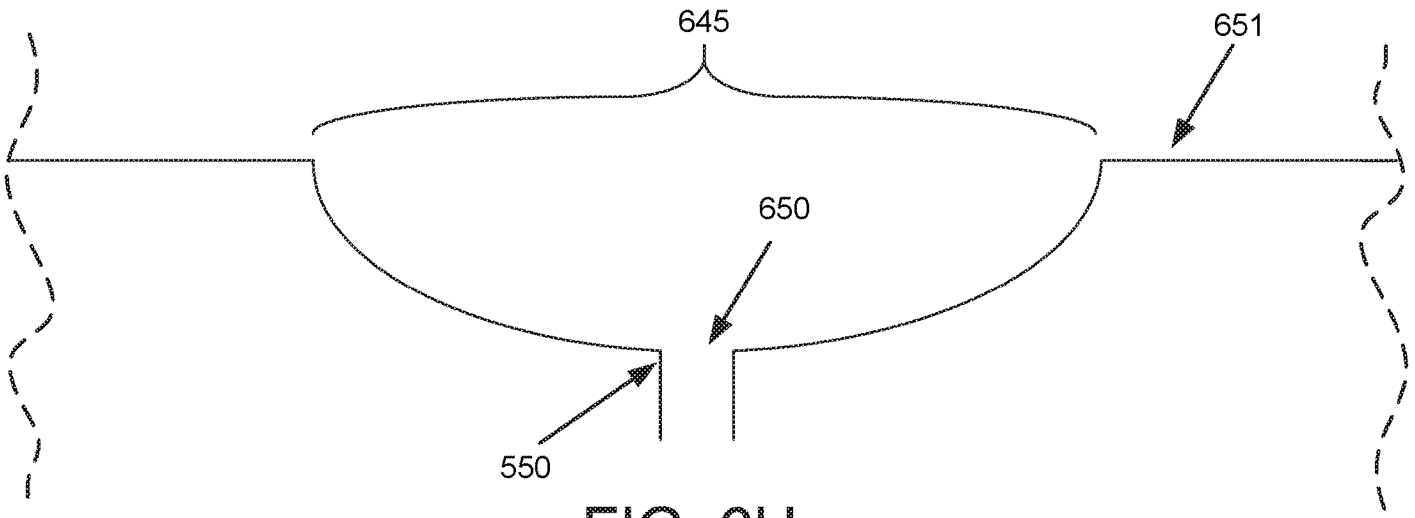
FIG. 6H shows a diagram of a first example of a port disposed in a recessed portion in accordance with one or more embodiments of the invention.

FIG. 6H shows a cross sectional diagram of a first example of an injection port (550) disposed in a recessed portion (645) in accordance with one or more embodiments of the invention. In FIG. 6H, the injection port (550) is dispose at the most recessed point (650) of the recessed portion. The most recessed point (650) is disposed at the center of the recessed portion (645) along the length of the needle. By disposing the injection port (550) at the most recessed point (650), the chance of tear-out is reduced because the port is recessed away from the surface (651) of the needle, e.g., the average diameter of the needle.

In one or more embodiments of the invention, the injection port (550) includes an opening disposed on a surface of the recessed portion (645). The injection port (550) may be a hollow cylindrical structure that extends into the interior of the needle. In one or more embodiments of the invention, the longitudinal axis of the hollow cylindrical structure passes through the most recessed point (650). In other embodiments of the invention, as will be discussed in more detailed with respect to FIGS. 6J and 6K, the longitudinal axis of the hollow cylindrical structure may not pass through the most recessed point of the recessed portion.

In one or more embodiments of the invention, an opening of an injection port may be disposed at a first distance from a longitudinal axis of a length of the needle. In other words, the injection port may be a cylindrical structure that extends radially from the longitudinal axis of the needle. The injection port may include an opening in the length needle. The extraction port may also be a cylindrical structure that extends radially from the longitudinal axis of the needle. The extraction port may also include an opening in the length of the needle that is at a second distance from the longitudinal axis of the length of the needle. In one or more embodiments of the invention, the first distance is less than the second distance. In other words, the opening of the injection port may be closer to the longitudinal axis of the length of the needle than the opening of the extraction port. Alternatively, the opening of the extraction port may be closer to the longitudinal axis of the length of the needle than the opening of the injection port without departing from the invention.

Figure 6I:
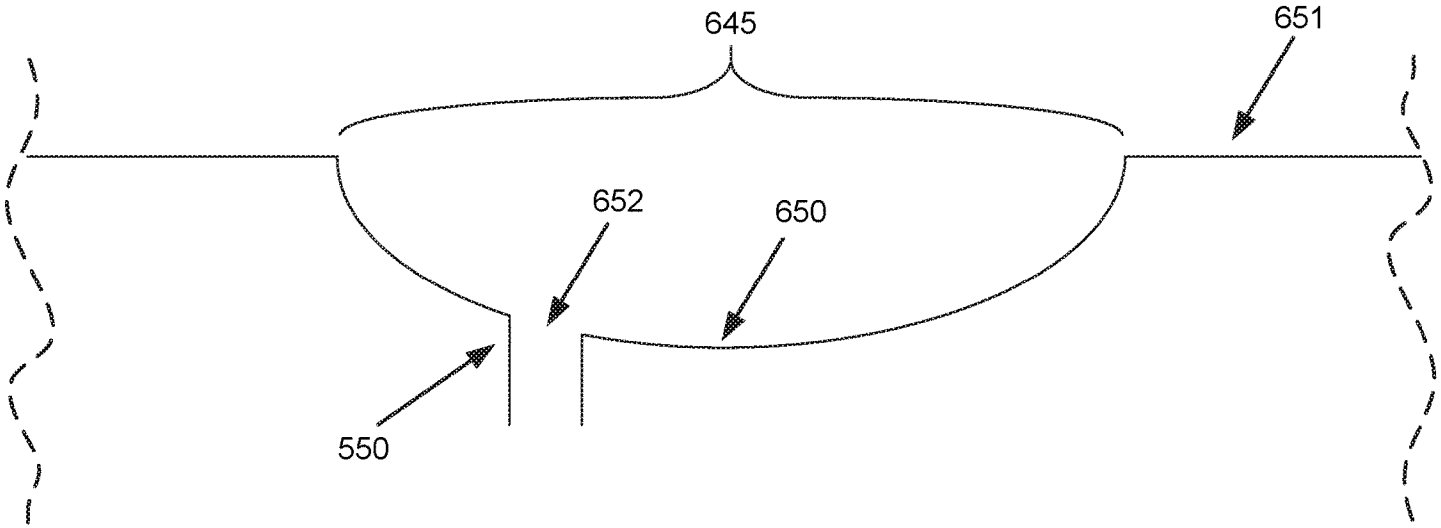
FIG. 6I shows a diagram of a second example of a port disposed in a recessed portion in accordance with one or more embodiments of the invention.

FIG. 6I shows a cross sectional diagram of a second example of an injection port (550) disposed in a recessed portion (645) in accordance with one or more embodiments of the invention. In FIG. 6I, the injection port (550) is dispose at an offset point (652) that is offset along the length of the recessed portion (645) from the most recessed point (650) of the recessed portion. By disposing the injection port (650) at an offset point (652), the chance of tear-out is reduced because the injection port (550) is recessed away from the surface (651) of the needle, e.g., the average diameter of the needle, and disposed at a location on the recessed portion which has a surface that is at an oblique angle to the surface (651) of the length of the needle.

Figure 6J:
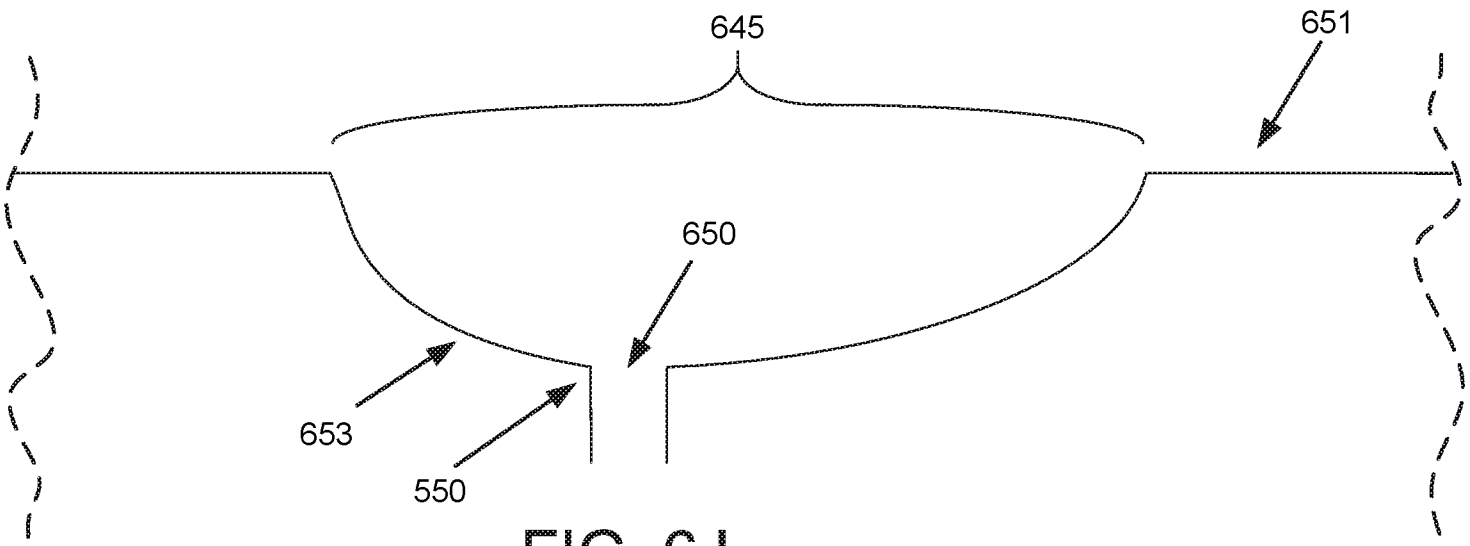
FIG. 6J shows a diagram of a third example of a port disposed in a recessed portion in accordance with one or more embodiments of the invention.

FIG. 6J shows a cross sectional diagram of a third example of an injection port (550) disposed in a recessed portion (645) in accordance with one or more embodiments of the invention. In FIG. 6J, the injection port (550) is dispose at the most recessed point (650) of the recessed portion (645). In contrast to FIG. 6H, however, the most recessed point (650) is offset from the center of the length of the recessed portion (645). By disposing the injection port (650) at the most recessed point (650) and offsetting the point from the center of the length of the recessed portion (645), the chance of tear-out is reduced because the injection port (550) is disposed at a location on the recessed portion (645) adjacent to a surface (653) that has a surface that is at an oblique angle to the surface (651) of the length of the needle.

Figure 6K:
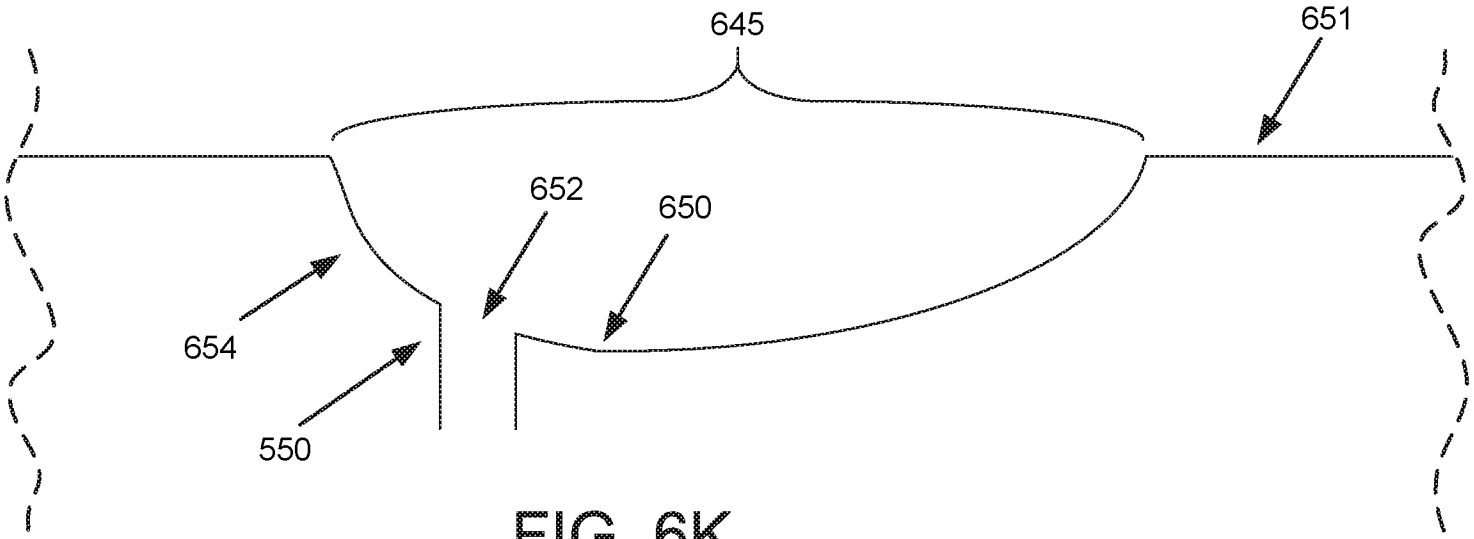
FIG. 6K shows a diagram of a fourth example of a port disposed in a recessed portion in accordance with one or more embodiments of the invention.

FIG. 6K shows a cross sectional diagram of a fourth example of an injection port (550) disposed in a recessed portion (645) in accordance with one or more embodiments of the invention. In FIG. 6K, the injection port (550) is dispose at an offset point (652) that is offset along the length of the recessed portion (645) from the most recessed point (650) of the recessed portion. Additionally, the most recessed point (650) is offset from the center of the length of the recessed portion (645). Thus, in FIG. 6K, the most recessed point (650) is offset from the center of the length of the recessed portion (645) and the injection port (652) is offset from the most recessed point (650). Disposing the injection port (650) as described decreases the chance of tear-out is reduced because the injection port (550) is disposed at a location on the recessed portion (645) adjacent to a surface (654) that has a surface that is at a highly oblique angle to the surface (651) of the length of the needle.

While FIGS. 6H-6K have been described with respect to an injection port, an extraction port may have similar characteristics without departing from the invention. For example, an extraction port may be disposed at a location within a recessed portion similarly to those locations described with respect to FIG. 6H-6K with respect to injection ports. Additionally, while FIGS. 6H-6K have illustrated the length, i.e., the longitudinal axis of the hole forming the port, of the injection port as being perpendicular to the length of the needle, the length of the an injection port and/or extraction port may be at an oblique angle to the length of the needle. For example, a length of any port may be oriented at a 30°, 45°, or 60° angle with respect to the length of the needle rather than being oriented at 90° with respect to the needle as illustrated in FIG. 6H-6K. The length of any port may be oriented at a different angle with respect to the length of the needle without departing from the invention.

Figure 6L:
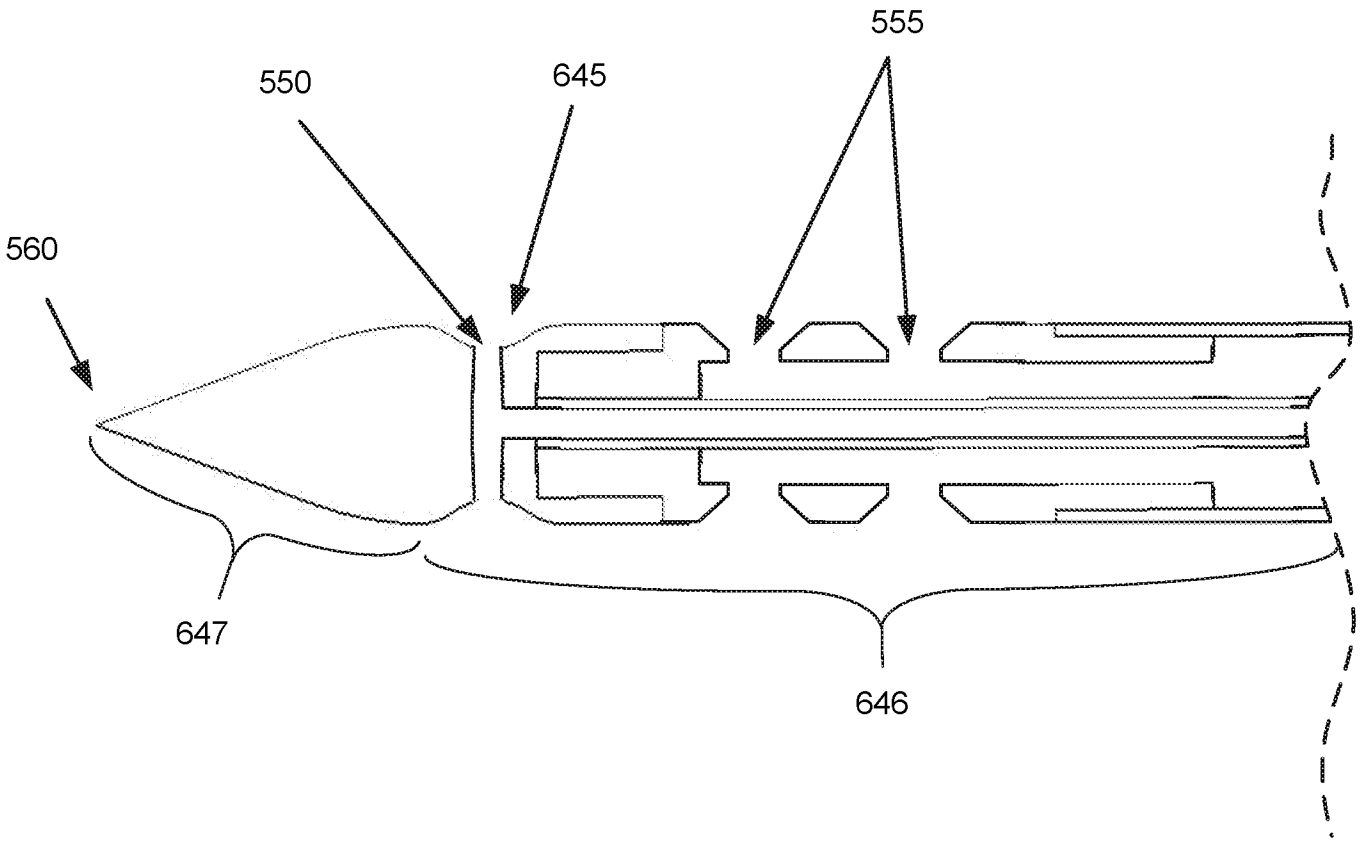
FIG. 6L shows a first cross section diagram of the sixth example of a needle in accordance with one or more embodiments of the invention.

FIG. 6L shows a cross sectional diagram of the sixth example shown in FIG. 6G. In one or more embodiments of the invention, the injection port (550) may be offset from the most recessed point of the recessed portion (645) along the length of the needle, as described with respect to FIGS. 6K and 6I. For example, in FIG. 6L, the injection port (550) are offset towards the point (560) of the needle along the length of the needle from the most recessed point of the recessed portion (645). Offsetting the injection port (550) towards the point (560) of the needle may further reduce the likelihood of tearing out a portion of the container while the needle is penetrating the container. In one or more embodiments, the injection port (550) may be disposed at the most recessed point of the recessed portion (645) without departing from the invention.

In one or more embodiments of the invention, the recessed portion (645) is not symmetrical along the length of the needle, as described with respect to FIGS. 6H and 6J. For example, the recessed portion (645) may be divided into two portions based on the most recessed point, i.e., the point of the recessed portion that is the closest to the longitudinal axis of the length of the needle. The first portion may be the portion located closer to the point (560) and the second portion may be the portion located further away from the point (560). The first portion may have a length that is shorter than the length of the second portion. The length of each portion may be the distance along the length of the needle from the most recessed portion to the first location along the length of the needle having the same diameter as that of length of the needle away from the point, i.e. on a side of the extraction ports (555) opposite the point.

Thus, by virtue of having a shorter length, the first portion of the recessed portion may have a surface with a steeper angle, e.g., may be at a more oblique angle to the surface of the needle, than that of the surface of the second portion. Increasing the steepness of the angle of the first portion, relative to the second portion, may further reduce the chance of tearing out a portion of the container while the needle is inserted into the container.

In one or more embodiments of the invention, the extraction ports (555) may be formed by subtractive machining of a block of metal. For example, the extraction ports (555) may be milled out of a block of aluminum. In one or more embodiments of the invention, the extraction ports (555) may be symmetrical about an axis of each port.

Figure 6M:
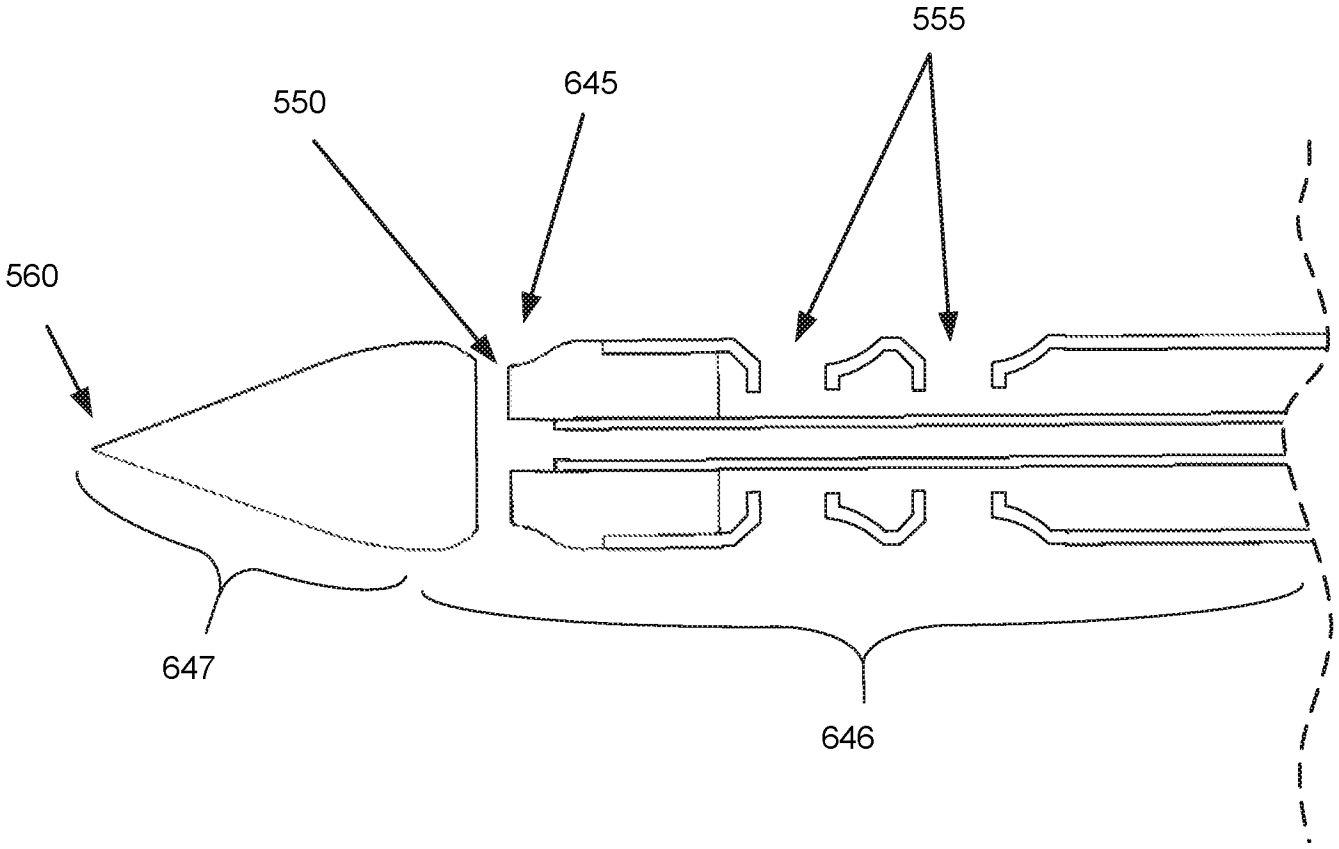
FIG. 6M shows a second cross section diagram of the sixth example of a needle in accordance with one or more embodiments of the invention.

FIG. 6M shows a cross sectional diagram of an alternative embodiment of the sixth example shown in FIG. 6G. In FIG. 6M, the extraction ports (555) may be manufactured by using a punch to cut circular pieces out of a tube. Punching, rather than machining the extraction ports (555) as described with respect to FIG. 6L, may result in some deformation of the tube near the site of each punch. Angling the punch, rather than cutting normal to the surface of the tube, while cutting out each circular portion may cause the resulting port (555) to not be symmetric, like the injection port (550) described with respect to FIG. 6L. Other methods of manufacturing asymmetrical extraction and/or injection ports may be used without departing from the invention.

While the needles shown in FIGS. 6G through 6M have been illustrated as having a smooth length, e.g., does not include threading, needles may include threading as shown in FIG. 6F without departing from the invention. In one or more embodiments of the invention, the threading may extend along the length of the needle. In one or more embodiments of the invention, the threading may extend along the length of the needle and along the tapered portion. In one or more embodiments of the invention, the threading may extend along the length of the needle, the tapered portion, and the point. In one or more embodiments of the invention, the threading may extend along a portion of the length of the needle, e.g., between the injection ports and the extraction ports. In one or more embodiments of the invention, the threading may extend along the tapered portion of the needle.

Figure 6N:
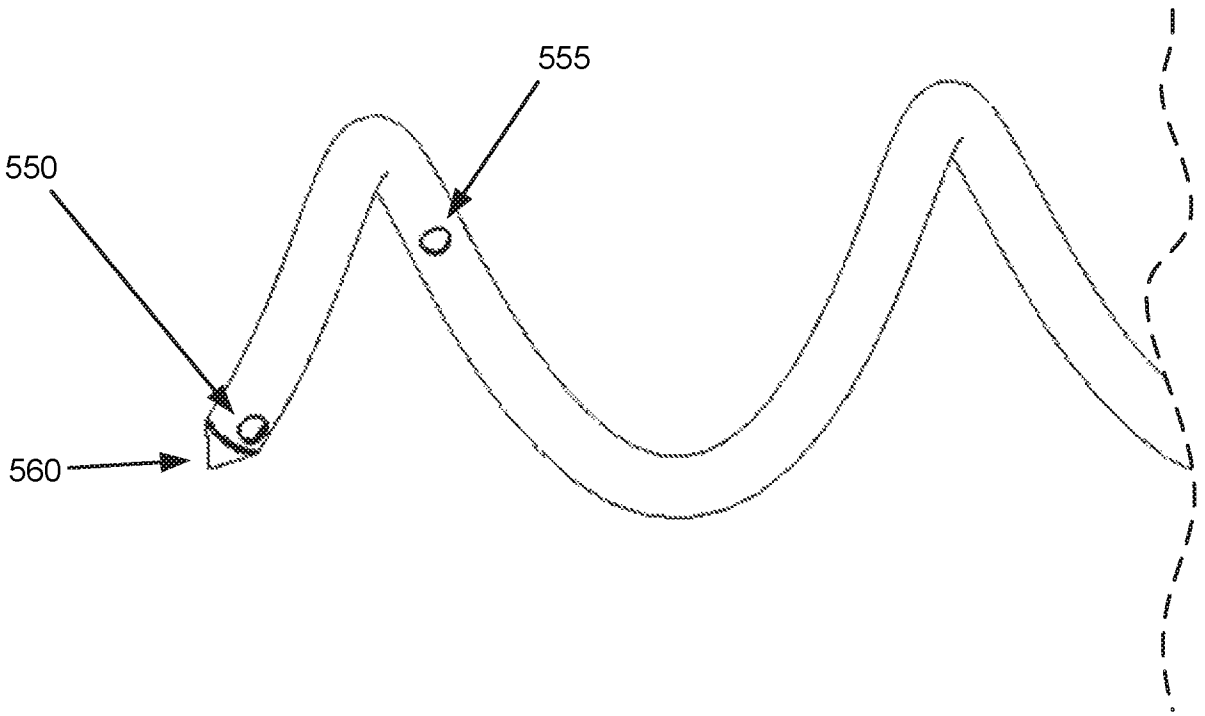
FIG. 6N shows a seventh example of a needle in accordance with one or more embodiments of the invention.

FIG. 6N shows an isometric diagram of a seventh example of a needle in accordance with one or more embodiments of the invention. The seventh example is similar to the needle (500) shown in FIGS. 5C and 6A. However, the length of the needle is formed into a helical, e.g., corkscrew, shape. The interior of the length of the needle may have multiple passages so that gas may be injected into a container utilizing one of the passage while fluid is being extracted from a container contemporaneously using a second passage.

Figure 6P:
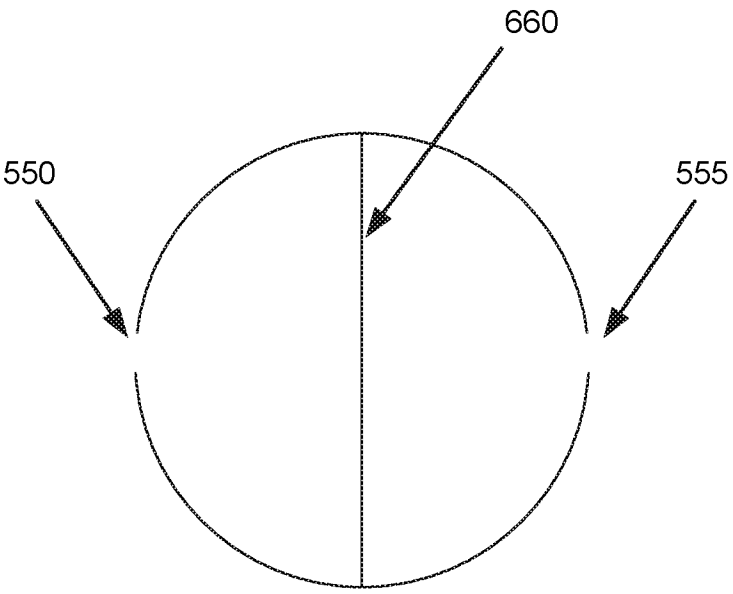
FIG. 6P shows a second cross section diagram of the seventh example of a needle in accordance with one or more embodiments of the invention.
Figure 6O:
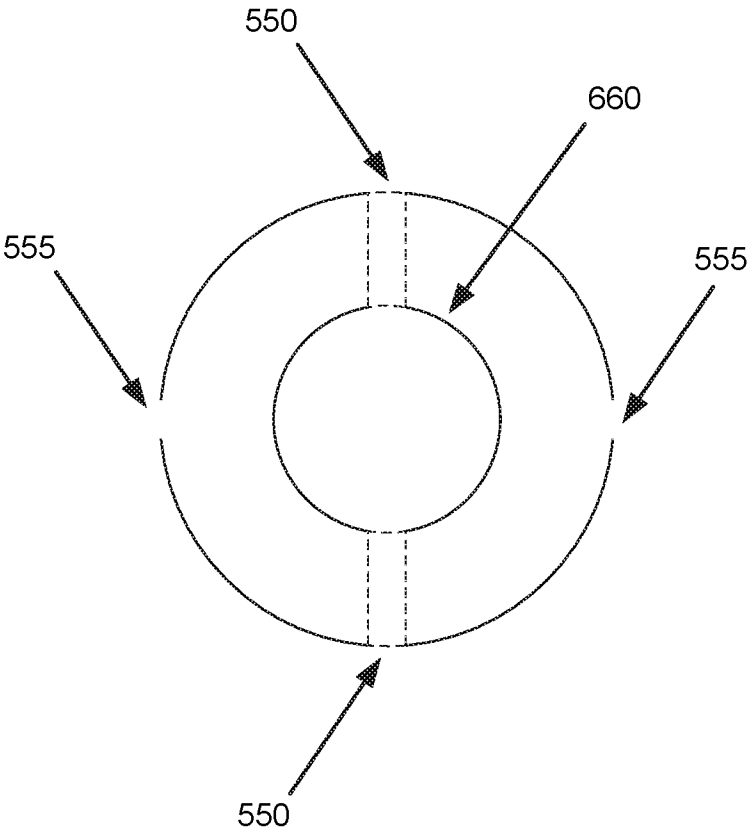
FIG. 6O shows a first cross section diagram of the seventh example of a needle in accordance with one or more embodiments of the invention.

FIG. 6O shows a first cross sectional diagram of the seventh example needle at the extraction ports (555). More specifically, FIG. 6O shows a cross section that is orthogonal to the length of the needle. As seen from the cross section diagram, the needle is separated into two compartments that run along the length of the needle. The first compartment is separated from the second compartment by an interior dividing wall (660). The first compartment is cylindrical in shape. The second compartment is tubular in shape and surrounds the first compartment. The first compartment is hydraulically connected to the injection port (550) and the second compartment is hydraulically connected to the extraction ports (555). In the figure, the dashed lines indicate the connection between first compartment and the injection port which is not present at the location of the first cross sectional diagram. The dashed lines are included for reference and do not indicate the presence of a physical structure at the location along the length of the needle that the first cross sectional diagram illustrates.

FIG. 6P shows a second cross sectional diagram of the seventh example needle. More specifically, FIG. 6P shows a cross section that is orthogonal to the length of the needle. As seen from the cross section diagram, the needle is separated into two compartments that run along the length of the needle. The compartments are delineated by a dividing wall (660) that extends along the length of the needle. The first compartment has a shape of half of a cylinder. The second compartment also has a shape of half of a cylinder. The first compartment is hydraulically connected to the injection port (550) and the second compartment is hydraulically connected to the extraction ports (555).

Figure 6Q:
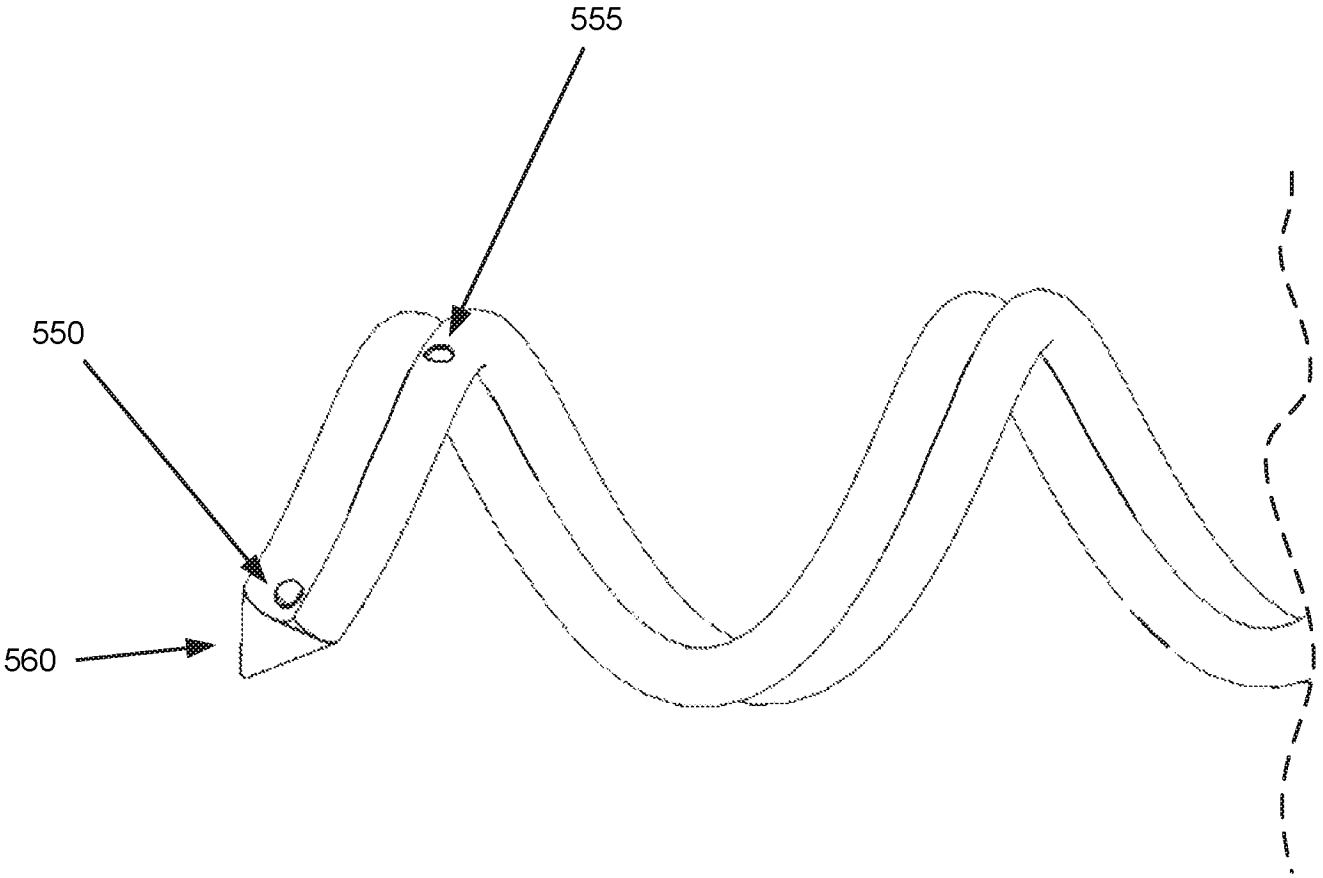
FIG. 6Q shows an eighth example of a needle in accordance with one or more embodiments of the invention.

FIG. 6Q shows an isometric diagram of an eighth example of a needle in accordance with one or more embodiments of the invention. The eighth example is similar to the needle (500) shown in FIG. 6N. However, the needle is formed of two separate cylindrical compartments that both follow a helical path. Each cylindrical compartment is hydraulically connected to the injection ports (550) or extraction ports (555), respectively. Each of the cylindrical compartments may be hydraulically isolated from each other along the length of the needle and thereby enable a gas to be pumped into a container using one of the paths while a fluid is extracted from the container using the other path.

While the helical needles shown in FIGS. 6N through 6Q have been shown as including one injection port and one extraction port, helical needles in accordance with one or more embodiments of the invention may have any number of injection ports and extraction ports. Further, the number of injection ports and extraction ports may be different without departing from the invention. Additionally, the size and/or shape of each injection port and/or extraction port may be the same or different from any other port without departing from the invention. In addition, while the length of the helical needles has been illustrated as being constant, recessed or projected portions as described with respect to FIGS. 6G through 6M may be disposed long the length of a helical needle without departing from the invention.

Figure 7:
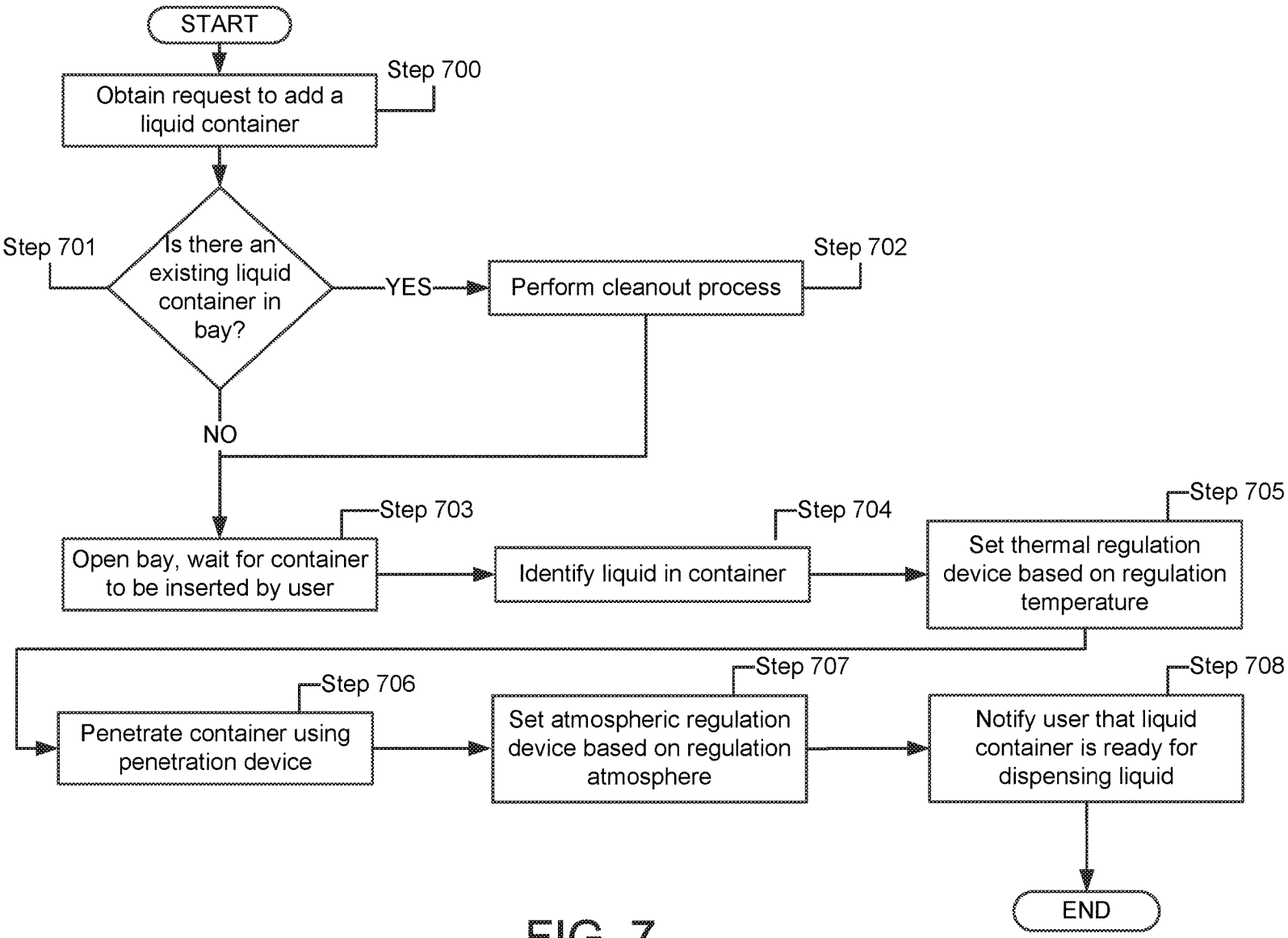
FIG. 7 shows a flowchart of a method of dispensing liquid in accordance with one or more embodiments of the invention.

FIG. 7 shows a flowchart in accordance with one or more embodiments of the invention. The method depicted in FIG. 7 may be used to dispense a liquid from a container in accordance with one or more embodiments of the invention. One or more steps shown in FIG. 7 may be omitted, repeated, and/or performed in a different order among different embodiments. The method shown in FIG. 7 may be performed by, for example, a liquid dispensing device.

In Step 700, a liquid dispensing device obtains a request to add a liquid container to the liquid dispensing device.

In one or more embodiments of the invention, the request is obtained from a user. The request may be obtained via a user interface. The liquid dispensing device may obtain the request through other methods without departing from the invention.

In Step 700, the liquid dispensing device determines whether there is an existing liquid container in a bay into which the container is to be added. If there is no existing container, the method proceeds to Step 703. If there is an existing container in the bay, the method proceeds to Step 702.

In Step 702, the liquid dispensing device initiates a clean out procedure.

When liquids are extracted from a container, the liquids may traverse piping, conduit, flow regulators, or other structures of the liquid dispensing device before the liquid is dispensed via a spout. While traversing the structures of the liquid dispensing device, sediment or other materials of a liquid may be disposed on the structures of the liquid dispensing device. If these materials are not removed before a second liquid is dispensed by the liquid dispensing device, the second liquid could pick up the material and be contaminated by the aforementioned materials. In one or more embodiments of the invention, a clean out procedure may be performed before inserting a new container. The cleanout procedure may remove debris, portions of the first liquid left in the device, or other materials so that a second liquid will not be contaminated when dispensed by the liquid dispensing device.

In one or more embodiments of the invention, the clean out procedure includes of retracting a penetration device disposed within the existing container and removing the existing container from the device.

In one or more embodiments of the invention, the clean out procedure further includes inserting a container including cleaning solution to the liquid dispensing device. Once inserted, the liquid dispensing device may automatically insert the penetration device into the cleaning solution and dispense cleaning solution. Dispensing cleaning solution may remove any contaminants from the liquid dispensing device introduced by the existing container.

In one or more embodiments of the invention, the clean out procedure further includes removing the container including cleaning solution system by retracting the penetration device from the container.

The method may proceed to Step 703 following Step 702.

In Step 703, the liquid dispensing device opens a bay and waits for a container to be inserted by the user.

In one or more embodiments of the invention, the liquid dispensing device may determine that a container has been inserted using a liquid container identification sensor described with respect to FIG. 2.

In Step 704, the liquid dispensing device determined a type of liquid included in the container.

In one or more embodiments of the invention, the liquid dispensing device may determine a type of liquid in the container using the liquid container identification sensor described with respect to FIG. 2.

In one or more embodiments of the invention, the liquid dispensing device may take a sensor reading of the container using the liquid container identification sensor. The sensor reading may be, for example, an image of the container.

In one or more embodiments of the invention, the liquid dispensing device may match the sensor reading to a library that relates sensor readings to liquid types. For example, if the sensor reading is an image of the container, the liquid dispensing device may compare the image to a library of packaging images. The image may include content from a label of the container. For example, a wine bottle may include a label that indicates a type of the wine, a year, a winery, and/or other information that may be used to uniquely identify the liquid in the wine bottle. In another example, a wine bottle may include a bar code, QR code, or other graphical indicator that may be used to identify the liquid in the wine bottle. Based on the comparison, the image reading may be matched to one of the library entries. The matched library entry may specify a type of liquid, a regulation temperature, and a regulation atmosphere. The library may include regulation temperature and/or regulation atmosphere recommended by a manufacturer of the liquid included in the container.

The liquid dispensing device may perform the match locally, e.g., if the library is stored on the device, or remotely, e.g., transmitting the sensor reading to another computing device on which the device is stored and receiving a response from the computing device.

In Step 705, the liquid dispensing device sets a thermal regulation device based on the regulation temperature. Setting the regulation temperature may cause a thermal regulation device to begin to monitor a temperature of the container and apply chilled or heated air flows to modify a temperature of the liquid disposed within the container.

In one or more embodiments of the invention, the regulation temperature may be the regulation temperature identified in Step 704. In other words, the regulation temperature may be set to a liquid provider's, such as a wine maker, recommended temperature for the liquid (also referred to as a temperature setting). In other embodiments of the invention, the regulation temperature may be set by a user via a user interface. For example, when a container is inserted into the device, a user of the device may set a regulation temperature via the interface.

In Step 706, the liquid dispensing device penetrates the container using a penetration device.

In one or more embodiments of the invention, the penetration device may be a needle as described with respect to FIGS. 4-6F. By penetrating the container, passages into the interior, liquid holding portion of the container may be formed.

In Step 707, the liquid dispensing device sets an atmospheric regulation device based on the regulation atmosphere determined in Step 704.

In one or more embodiments of the invention, the atmospheric regulation device may inject gasses, via the needle, into the container to adjust an atmosphere within the container. The gasses may be, for example, argon or nitrogen. The atmospheric regulation device may regulate a type of atmosphere, by injecting a specified type of gas, and a pressure of the atmosphere, by injecting a quantity of gas until a pressure regulator indicates the pressure is at the specified pressure.

In Step 708, the liquid dispensing device notifies a user that the container is prepared for liquid dispensing.

In one or more embodiments of the invention, the liquid dispensing device notifies the user via the user interface.

Figure 8:
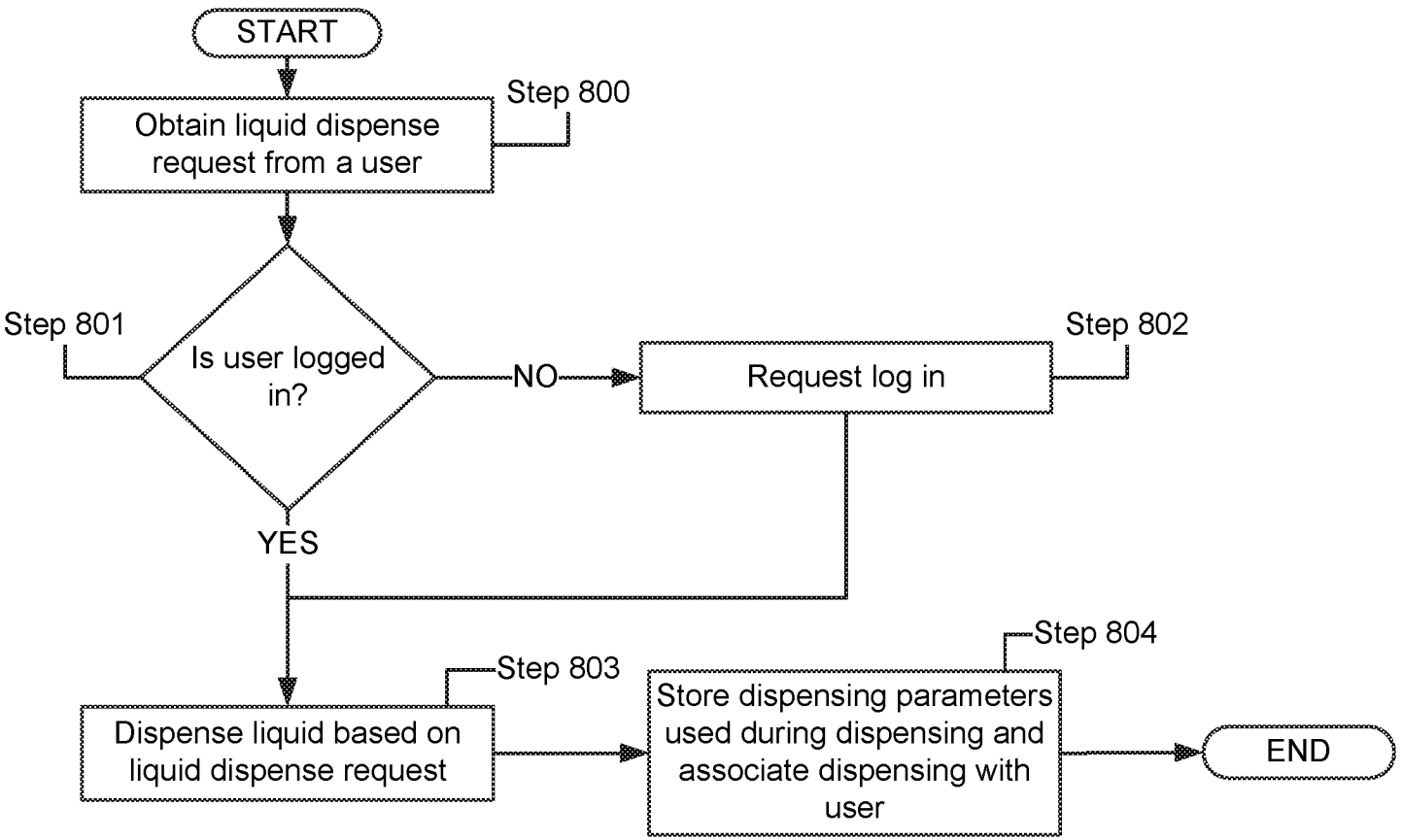
FIG. 8 shows a flowchart of a method of dispensing liquid in accordance with one or more embodiments of the invention.

FIG. 8 shows a flowchart in accordance with one or more embodiments of the invention. The method depicted in FIG. 8 may be used to dispense a liquid from a container in accordance with one or more embodiments of the invention. One or more steps shown in FIG. 8 may be omitted, repeated, and/or performed in a different order among different embodiments. The method shown in FIG. 8 may be performed by, for example, a liquid dispensing device.

In Step 800, a liquid dispensing device obtains a request to dispense a liquid.

In one or more embodiments of the invention, the request may be obtained via a user interface from a user.

In Step 801, the liquid dispensing device determines whether the user is logged into the device. If the user is logged into the device, the method proceeds to step 803. If the user is not logged into the device, the method proceeds to step 802.

In Step 802, the liquid dispensing device requests that the user log into the device.

In one or more embodiments of the invention, the liquid dispensing device may request that the user log on by displaying a message to the user on the user interface. In response to the request, the user may input his or her login credentials.

In one or more embodiments of the invention, the liquid dispensing device may verify the login credentials by contacting an authentication network element. In one or more embodiments of the invention, the liquid dispensing device may verify the login credentials by comparing them to a set stored in a memory if the liquid dispensing device. If the credentials cannot be verified, the liquid dispensing device may refuse to dispense liquid until verifiable credentials are provided.

In one or more embodiments of the invention, the device may display a key pad on a user interface to a user of the device and prompt the user to enter an identification code that identifies the user. The user may enter the code via the key pad.

In one or more embodiments of the invention, the location of each key of the keypad may change every time the user is prompted to enter the identification code. For example, if the users are given a numerical identification code, the device may display a numerical key pad. Each time that the numerical keypad is displayed, the number displayed on each button of the key pad may be different. Changing a location of the characters displayed by the interface may reduce overuse of portions of a user interface and, thereby, extending the working life of the user interface.

In Step 803, the liquid dispensing device may dispense liquid based on the request. In one embodiment of the invention, the liquid may be aerated by the liquid dispensing device at any time prior the dispensing. The amount of aeration to be applied to the liquid may be determined, at least in part, on the varietal of the liquid.

In one or more embodiments of the invention, the request specifies a type of liquid and a quantity of the liquid.

In Step 804, the liquid dispensing device may store dispensing parameters of the dispensing performed in Step 803 and associated the dispensing parameters with the user.

In one or more embodiments of the invention, the dispensing parameters may specify a varietal of the liquid, a vintage of the liquid, a region of the liquid, a producer of the liquid, a type of the liquid, a time of the dispensing, a quantity of the dispensing, a location of the liquid dispensing device at the time and/or date of the dispensing, and information associated with the user that requested the dispensing. The information associated with the user may include the sex of the user, the age of the user, and the income of the user. The dispensing parameters may also include parameters of the dispensing system including a quantity of gas remaining in the liquid dispensing device for injection into the container, the current/voltage relationship over time of each of the computing/motors in the device.

In one or more embodiments of the invention, all or a portion of the dispensing parameters may be transmitted to a recommendation network element (130, FIG. 1) and stored as part of a consumption history associated with the user.

The method may end following Step 804.

Figure 9B:
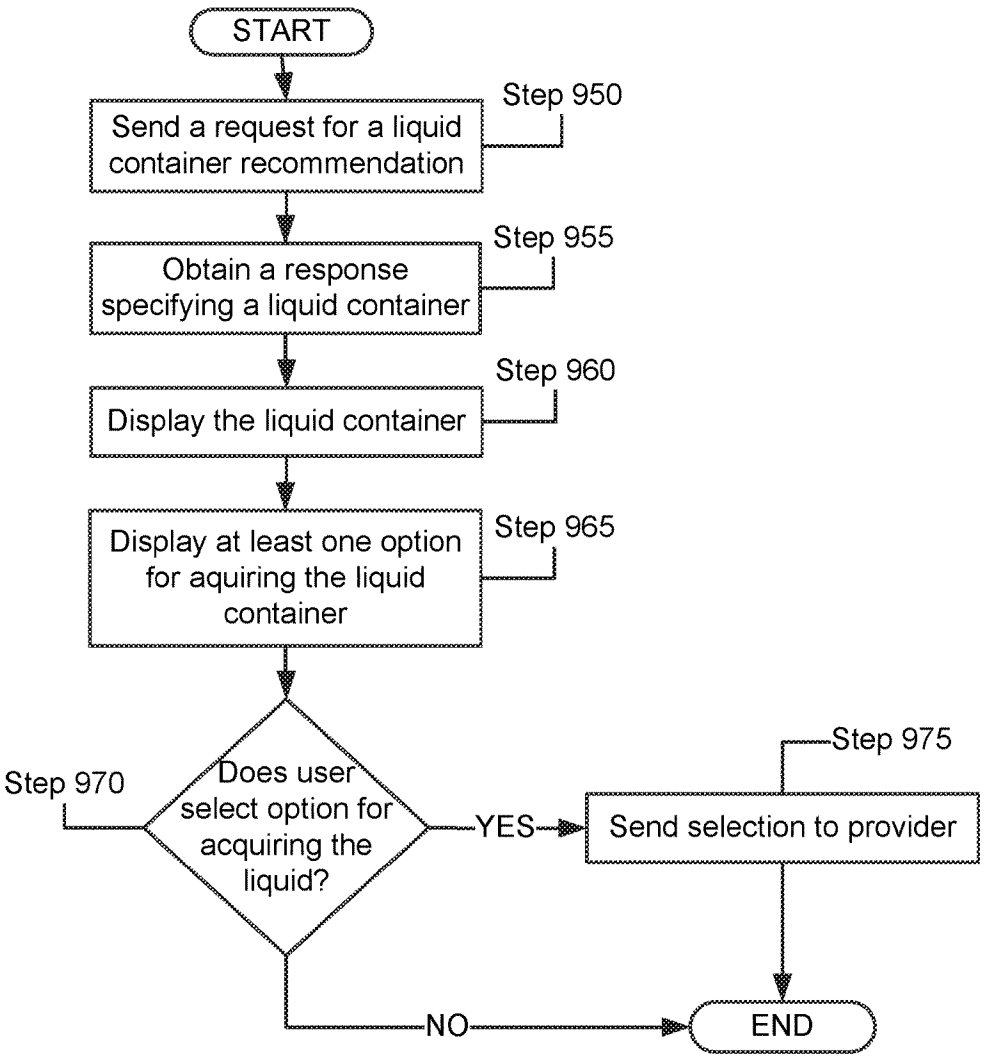
FIG. 9B shows a flowchart of a method of recommending a liquid container in accordance with one or more embodiments of the invention.
Figure 9A:
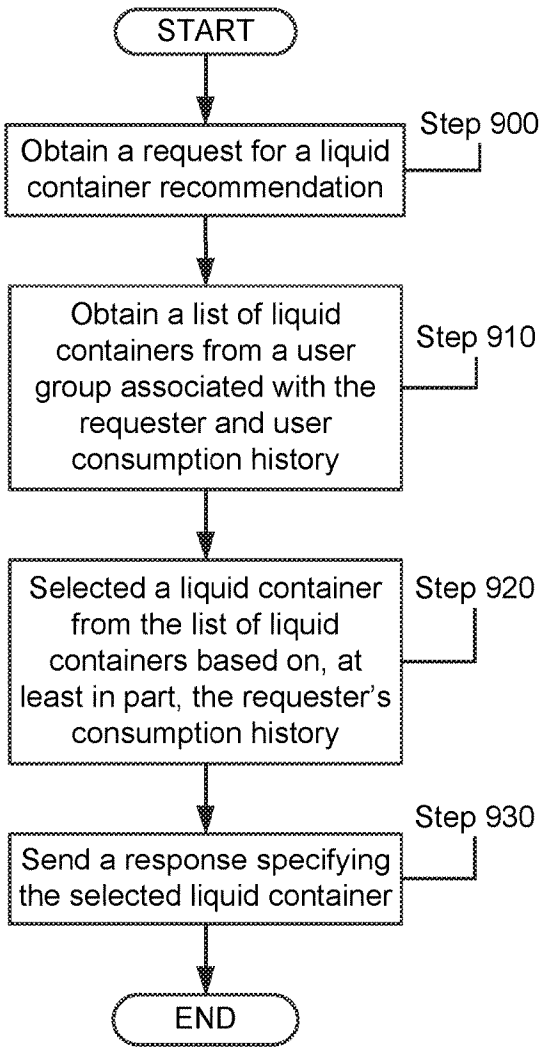
FIG. 9A shows a flowchart of a method of recommending a liquid container in accordance with one or more embodiments of the invention.

FIG. 9A shows a flowchart in accordance with one or more embodiments of the invention. The method depicted in FIG. 9A may be used to recommend a liquid container for a user in accordance with one or more embodiments of the invention. One or more steps shown in FIG. 9A may be omitted, repeated, and/or performed in a different order among different embodiments. The method shown in FIG. 9A may be performed by, for example, a recommendation network element.

In Step 900, a recommendation network element obtains a request for a liquid container recommendation.

In one or more embodiments of the invention, the request may specify a user. The request may be obtained from a liquid dispensing device.

In Step 910, the recommendation network element may obtain a list of liquid containers from a user group associated with the requester and/or a consumption history of the user.

In one or more embodiments of the invention, the user group may be obtained by comparing the user to a list of other users. Each of the other users may be either associated with the user or not associated with the user. The user group may be obtained by forming a list of other users that are associated with the user.

In one or more embodiments of the invention, the list of liquid containers may be formed by aggregating liquid containers that have been consumed by one of the other users specified in the user group based on a consumption history of each of the other users.

In one or more embodiments of the invention, the consumption history may be a listing of liquid dispensed by liquids dispensing devices to the user.

In one or more embodiments of the invention, the consumption history of the user may be analyzed to determine types of liquids consumed by the user. Containers of liquids from commercial vendors may be added to the list of containers based on the types of liquids consumed by the user.

In Step 920, the recommendation network element selects a liquid container of the liquid containers specified in the list of liquid containers by matching the consumption history of the user to one of the liquid containers.

In some embodiments of the invention, the user may select whether the user desires a recommendation based on the users user group, suggestions from vendors, other sources, and/or a combination of the aforementioned sources. If a selection is made by the user, the recommendation may be limited to the selected sources.

In Step 930, the recommendation network element sends a response specify the selected liquid container.

In one or more embodiments of the invention, the response may be sent to the liquid dispensing device.

FIG. 9B shows a flowchart in accordance with one or more embodiments of the invention. The method depicted in FIG. 9B may be used to recommend a liquid container for a user in accordance with one or more embodiments of the invention. One or more steps shown in FIG. 9B may be omitted, repeated, and/or performed in a different order among different embodiments. The method shown in FIG. 9B may be performed by, for example, a recommendation network element.

In Step 950, a liquid dispensing device may send a request to a recommendation network element specifying a user.

In Step 955, the liquid dispensing device obtains a response specifying a liquid container.

In Step 960, the liquid dispensing device displays an image of the liquid container to the user.

In Step 965, the liquid dispensing device displays an option for acquiring the liquid container to the user.

In Step 970, the liquid dispensing device determines whether the user selected the option for acquiring the liquid container. If the liquid dispensing devices determines that the user selected the option for the acquiring the liquid container, the method proceeds to Step 975. If the liquid dispensing device determines that the user did not select the option for acquiring the liquid container, the method may end following Step 970.

In Step 975, the liquid dispensing device sends the selection to a provider of the liquid container.

For example, if the liquid dispensing device is disposed within a hotel, the liquid dispensing device may send the request to housekeeping or room service so that the selected liquid container will be provided to the user.

The method may end following Step 975.

FIG. 10 shows a block diagram of a liquid identification network element (120) in accordance with embodiments of the invention. The liquid identification network element (120) may identify a liquid based on sensor readings of a container in which the liquid is disposed.

The liquid identification network element (120) may include a processor (1050). The processor (1050) may be a physical device, including circuitry. The processor (1050) may be, for example, a central processing unit, an embedded processor, a digital signal processor, a programmable gate array, or any other type of programmable computing device.

The processor (1050) may be operably connected to a non-transitory computer readable memory (1055) storing instructions. The non-transitory computer readable memory (1055) may be a physical device such as a hard disk drive, a read only memory, or a solid state drive. The instructions, when executed by the processor (1050), may cause the liquid identification network element (120) to perform the functionality described throughout this application and shown in FIGS. 7-9B.

The liquid identification network element (120) may include memory (1060) operably connected to the processor. The memory (1060) may be a physical device such as random access memory. The memory (1060) may be used for the temporary storage of data.

In one or more embodiments of the invention, the memory (1060) may store a library consisting of entries (1000, 1010). Each entry may include an identifier (1001, 1011). Sensor readings of a container may be compared to each identifier (1001, 1011) to determine a matching library entry.

In one or more embodiments of the invention, each library entry specifies a liquid type (1002, 1012), a varietal (1003, 1013,), a region (1004, 1014), a vintage (1005, 1015), and/or a winery (1006, 1016). Each library entry may also specify a regulation temperature and a regulation atmosphere.

The liquid identification network element (120) may include a network adapter (1065). The network adapter (1065) may be a physical device for accessing a network. The network adapter may be, for example, an Ethernet adapter, a fiber optic network adapter, or a wireless network adapter. The network adapter (1065) may enable the liquid identification network element (120) to exchange information with network elements (e.g., 120, 130, 140, 150, etc.) and/or liquid dispensing devices.

The liquid identification network element (120) may include a user interface (1070). The user interface (1070) may be a physical device for interacting with the liquid identification network element (120). The liquid identification network element (120) may include, for example, a display, a touch sensitive display, buttons, and/or switches. The user interface (1070) may enable the liquid identification network element (120) to present information to a user and receive input from the user.

FIG. 11 shows a block diagram of a recommendation network element (130) in accordance with embodiments of the invention. The recommendation network element (130) may store a consumption history of each user and group associations between users.

The recommendation network element (130) may include a processor (1150). The processor (1150) may be a physical device, including circuitry. The processor (1150) may be, for example, a central processing unit, an embedded processor, a digital signal processor, a programmable gate array, or any other type of programmable computing device.

The processor (1150) may be operably connected to a non-transitory computer readable memory (1155) storing instructions. The non-transitory computer readable memory (1155) may be a physical device such as a hard disk drive, a read only memory, or a solid state drive. The instructions, when executed by the processor (1150), may cause the recommendation network element (130) to perform the functionality described throughout this application and shown in FIGS. 7-9B.

The recommendation network element (130) may include memory (1160) operably connected to the processor. The memory (1160) may be a physical device such as random access memory. The memory (1160) may be used for the temporary storage of data.

In one or more embodiments of the invention, the memory (1160) may store a library consisting of entries (1100, 1110). Each entry may include a consumption history of a user (1101, 1111) a group associations (1102, 1112) between the user and other users.

The recommendation network element (130) may include a network adapter (1165). The network adapter (1165) may be a physical device for accessing a network. The network adapter may be, for example, an Ethernet adapter, a fiber optic network adapter, or a wireless network adapter. The network adapter (1165) may enable the recommendation network element (130) to exchange information with network elements (e.g., 120, 130, 140, 150, etc.) and/or liquid dispensing devices.

The recommendation network element (130) may include a user interface (1170). The user interface (1170) may be a physical device for interacting with the recommendation network element (130). The recommendation network element (130) may include, for example, a display, a touch sensitive display, buttons, and/or switches. The user interface (1170) may enable the recommendation network element (130) to present information to a user and receive input from the user.

Embodiments of the invention may provide one or more of the following advantages: (i) embodiments of the invention may enable automatic dispensing of liquid from a container, (ii) embodiments of the invention may enable rapid dispensing of liquid from a container that is sealed by injecting gas into the sealed container to maintain a pressure inside the container while the liquid is dispensed, (iii) embodiments of the invention may enable automatic penetration of container sealing devices such as corks, screw tops, or other structures, (iv) embodiments of the invention may enable liquids that are carbonated or otherwise include a dissolved gas to be preserved by maintaining a pressure level within a container after the container is penetrated to remove a portion of the liquid from the container, (v) embodiments of the invention may reduce dispensing of sediment or other materials disposed within a container along with a liquid in the container by maintaining an orientation of the container that prevents the sediment or other materials from being dispensed (e.g., the origination of the container may force the sediment to settle in the shoulder of the container), (vi) embodiments of the invention may hide the container from a view of the user while liquid is dispensed from the container, (vii) embodiments of the invention may preserve the remaining portion of liquid in the container by controlling an atmosphere within the container and a temperature of the liquid disposed within the container, (viii) embodiments of the invention may automatically notify providers of liquid containers when a container is depleted and thereby automatically have a new container be installed or scheduled for installation, and (ix) embodiments of the invention may enable characteristics of a liquid disposed within a container may be automatically determined and a regulation temperature and atmosphere of the liquid may automatically be set.

While the invention has been described above with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A liquid dispensing device, comprising:

a needle adapted to penetrate a container without tearing out a portion of the container near a point of penetration on the container, wherein the needle comprises:

a smooth cylindrical body;

a plurality of extraction ports for extracting a liquid from the container, wherein each extraction port of the plurality of extraction ports comprises:

an extraction recessed portion; and an extraction opening disposed in the extraction recessed portion; and an injection port for injecting a gas into the container; and a motion control system configured to rotate the needle while the needle penetrates the container.

2. The device of claim 1, wherein the injection port and the plurality of extraction ports are hydraulically separated from each other within the needle.

3. The device of claim 2, wherein the needle further comprises:

a point;

a tapered portion; and a length.

4. The device of claim 3, wherein the injection port is disposed between the point and the plurality of extraction ports.

5. The device of claim 3, wherein the injection port is disposed between the tapered portion and the plurality of extraction ports.

6. The device of claim 3, wherein the tapered portion tapers from the point to a first diameter, wherein the length has a second diameter, wherein the first diameter is smaller than the second diameter.

7. The device of claim 3, wherein the needle further comprises:

a recessed portion having a first diameter, wherein the length has a second diameter, wherein the first diameter is smaller than the second diameter.

8. The device of claim 7, wherein the recessed portion is disposed between the point and the plurality of extraction ports.

9. The device of claim 7, wherein the recessed portion is disposed between the tapered portion and the plurality of extraction ports.

10. The device of claim 7, wherein the recessed portion is disposed along the length of the needle.

11. The device of claim 7, wherein the injection port is disposed in the recessed portion.

12. The device of claim 7, wherein the recessed portion is not symmetric along the length of the needle.

13. The device of claim 7, wherein the injection port is offset along the length of the needle from a most recessed point of the recessed portion.

14. The device of claim 1, wherein the needle further comprises:

an injection opening of the injection port disposed at a first distance from a longitudinal axis of the smooth cylindrical body; and wherein the extraction opening is at a second distance from a longitudinal axis of the smooth cylindrical body, wherein the first distance is less than the second distance.

15. The device of claim 14, wherein the needle further comprises:

a point disposed along the longitudinal axis of the smooth cylindrical body; and a tapered portion disposed between the point and the smooth cylindrical body.

16. The device of claim 14, wherein a longitudinal axis of the injection port is oblique to the longitudinal axis of the smooth cylindrical body.

17. The device of claim 14, wherein the needle further comprises:

a recessed portion, wherein the opening of the injection port is disposed in the recessed portion.

18. The device of claim 17, wherein the recessed portion is asymmetrical about the opening of the injection port.

19. The device of claim 17, wherein the opening of the injection port is not disposed at a most recessed point of the recessed portion.

20. The device of claim 17, wherein the recessed portion is asymmetrical about a most recessed point of the recessed portion.

* * * * *